US011318748B2

(12) United States Patent
Mizutani et al.

(10) Patent No.: US 11,318,748 B2
(45) Date of Patent: May 3, 2022

(54) LIQUID SUPPLY SYSTEM AND LIQUID CONTAINER

(71) Applicant: SEIKO EPSON CORPORATION, Tokyo (JP)

(72) Inventors: Tadahiro Mizutani, Shiojiri (JP); Taku Ishizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/913,725

(22) Filed: Jun. 26, 2020

(65) Prior Publication Data

US 2020/0406625 A1 Dec. 31, 2020

(30) Foreign Application Priority Data

Jun. 28, 2019 (JP) ..... JP2019-121050

(51) Int. Cl.

*B41J 2/175* (2006.01)
*B41J 29/02* (2006.01)
*B41J 29/13* (2006.01)

(52) U.S. Cl.

CPC ..... *B41J 2/17523* (2013.01); *B41J 2/1752* (2013.01); *B41J 2/17509* (2013.01); *B41J 2/17513* (2013.01); *B41J 2/17553* (2013.01); *B41J 2/17566* (2013.01); *B41J 29/02* (2013.01); *B41J 29/13* (2013.01)

(58) Field of Classification Search

CPC .... B41J 2/175; B41J 2/17506; B41J 2/17509; B41J 2/17513; B41J 2/1752; B41J 2/17523; B41J 2/17553; B41J 2/17566; B41J 29/02; B41J 29/13

See application file for complete search history.

(56) References Cited

U.S. PATENT DOCUMENTS 5,631,681 A * 5/1997 Klaus ..... B41J 2/17509 347/85
5,933,173 A * 8/1999 Solero ..... B41J 2/17506 347/85
7,926,928 B2 * 4/2011 Umeda ..... B41J 2/17509 347/87
2017/0355191 A1 12/2017 Mizutani et al.
2017/0355194 A1 12/2017 Fukasawa et al.

(Continued)

FOREIGN PATENT DOCUMENTS

JP 2018-161851 A 10/2018
JP 2019-051723 A 4/2019

*Primary Examiner* — Anh T Vo
(74) *Attorney, Agent, or Firm* — Oliff PLC

(57) ABSTRACT

A liquid supply system includes a carriage, a plurality of tanks mounted on the carriage, and a plurality of liquid containers for filling a corresponding tank of the plurality of tanks with liquid. The plurality of tanks include a first tank and a second tank in which liquid receiving sections are arranged adjacent to each other in an arrangement direction in the carriage, the plurality of liquid containers include a first liquid container for filling the first tank with the liquid and a second liquid container for filling the second tank with the liquid, and the first liquid container has a portion that, when the first liquid container is set to a first tank filling posture, interferes with a disposition region of the second liquid container when the second liquid container is set to a second tank filling posture.

7 Claims, 19 Drawing Sheets

(56) References Cited

U.S. PATENT DOCUMENTS

| | | | | |
|---|---|---|---|---|
| 2017/0355195 | A1 | 12/2017 | Fukasawa et al. | |
| 2017/0355196 | A1 | 12/2017 | Shinada et al. | |
| 2017/0355197 | A1 | 12/2017 | Kudo et al. | |
| 2018/0244054 | A1* | 8/2018 | Kanaya | B41J 2/17513 |
| 2018/0272731 | A1 | 9/2018 | Kimura et al. | |
| 2019/0299624 | A1 | 10/2019 | Mizutani et al. | |
| 2019/0299625 | A1 | 10/2019 | Mizutani et al. | |

* cited by examiner

LIQUID SUPPLY SYSTEM AND LIQUID CONTAINER

The present application is based on, and claims priority from JP Application Serial Number 2019-121050, filed Jun. 28, 2019, the disclosure of which is hereby incorporated by reference herein in its entirety.

BACKGROUND

1. Technical Field

The present disclosure relates to a liquid supply system and a liquid container.

2. Related Art

For example, each of JP-A-2018-161851 and JP-A-2019-51723 below discloses an ink jet type printer including an ink supply system that supplies ink from a tank to a liquid jet head mounted on a carriage. In any of the ink supply systems of JP-A-2018-161851 and JP-A-2019-51723, it is configured such that a user can replenish ink from a liquid container to the tank.

A printer disclosed in JP-A-2018-161851 is for monochrome printing, and only one tank is mounted on a carriage together with a recording head. However, in a printer, a plurality of tanks may be mounted on one carriage. In such a configuration, for a large number of tanks, when a large number of liquid containers are simultaneously coupled to the tanks of the carriage in order to refill with the ink at one time, the weight of the liquid container may cause the installation posture of the carriage to shift from a prescribed posture and the carriage may be deformed. When such a shift or deformation of the installation posture of the carriage occurs, a gap between the liquid jet head and a printing medium changes or becomes non-uniform, so that the printing quality may deteriorate. Further, as described above, when refilling a large number of tanks with ink from a large number of liquid containers at the same time, there is also a concern that a user may increase the possibility of erroneous handling of the liquid containers, spilling ink, and contaminating the carriage.

In JP-A-2018-161851 described above, since only one tank is mounted on a carriage as described above, there is no recognition of the above-described problem peculiar to a configuration in which a plurality of tanks are mounted on such a carriage. Also, in JP-A-2019-51723 described above, since a tank is not mounted on a carriage, there is no recognition of the above-described problem peculiar to the configuration in which a plurality of tanks are mounted on the carriage. Such a problem is not limited to an ink supply system incorporated in an ink jet type printer, but is a problem common to various liquid supply systems for supplying liquid other than ink to a liquid jet head.

SUMMARY

One aspect of the technology of the present disclosure is provided as a liquid supply system for supplying liquid to a liquid jet head that discharges the liquid. The liquid supply system according to this aspect includes: a carriage on which the liquid jet head is mounted; a plurality of tanks mounted on the carriage and having a storing section that stores the liquid and a liquid receiving section that receives a liquid for filling the storing section with the liquid from an outside; and a plurality of liquid containers each having a container section that stores the liquid and a liquid outlet port that communicates with an internal space of the container section, and filling a corresponding tank among the plurality of tanks with the liquid in the container section in a state where the liquid outlet port is coupled to the liquid receiving section. The plurality of tanks include a first tank and a second tank in which the liquid receiving sections are disposed adjacent to each other in an arrangement direction in the carriage, the plurality of liquid containers include a first liquid container that fills the first tank with the liquid and a second liquid container that fills the second tank with the liquid, and the first liquid container has a portion that, when the first liquid container is set to a predetermined first tank filling posture for filling the first tank with the liquid, interferes with a disposition region of the second liquid container when the second liquid container is set to a predetermined second tank filling posture for filling the second tank with the liquid.

DESCRIPTION OF EXEMPLARY EMBODIMENTS

Figure 1:
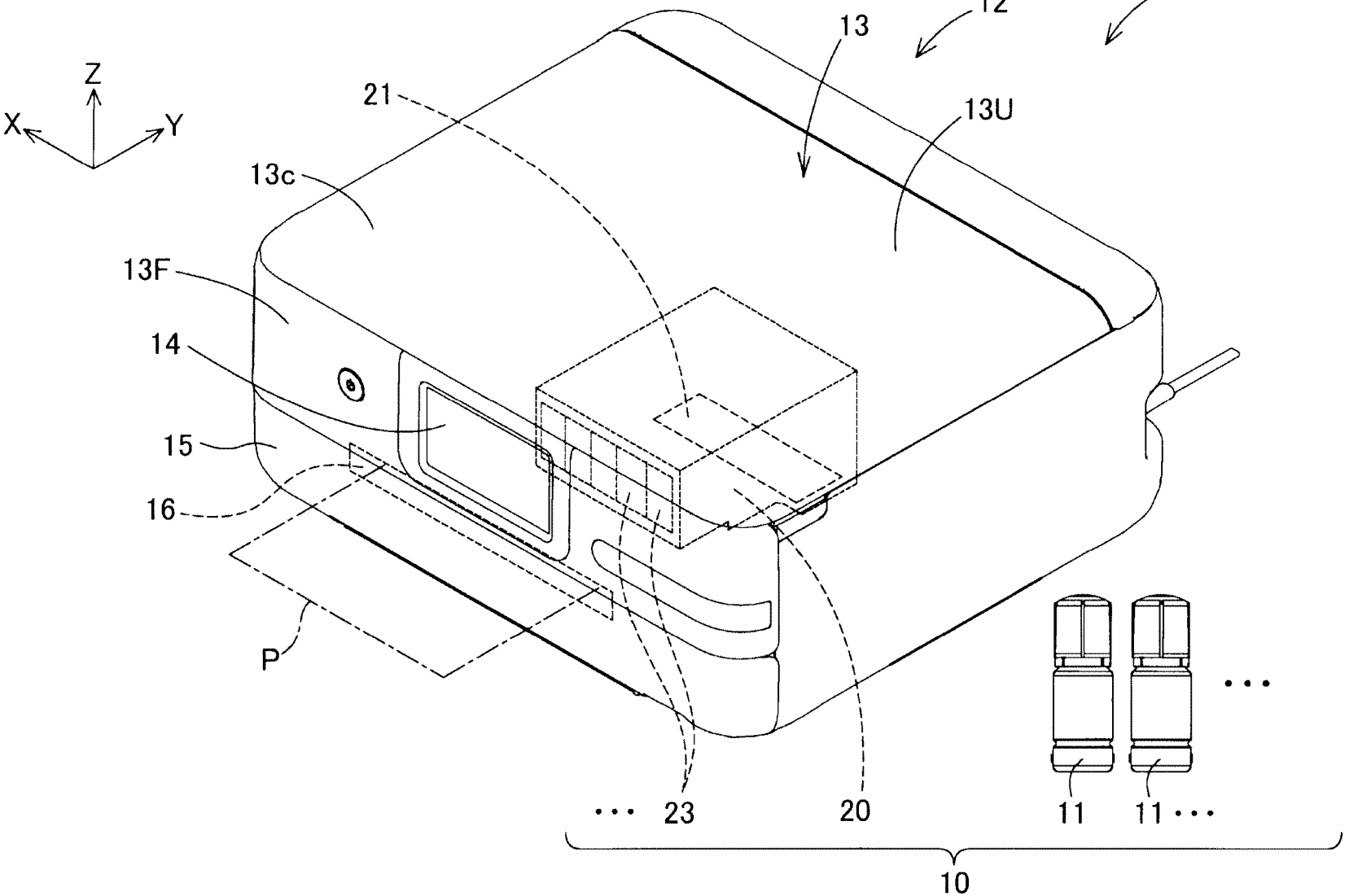
FIG. 1 is a schematic view showing a configuration of a liquid consumption system in which a liquid supply system is incorporated.

1. First Embodiment 1-1. Overview of Liquid Consumption System and Liquid Supply System:

FIG. 1 is an outline view showing a liquid consumption system 100 in which a liquid supply system 10 of a first embodiment is incorporated. The liquid consumption system 100 includes a plurality of liquid containers 11 storing liquid and a liquid consumption apparatus 12 that consumes liquid refilled from the liquid container 11 by a user. In the first embodiment, the liquid consumption apparatus 12 is an ink jet type printer, and the liquid in the liquid container 11 is ink used for printing. As will be described later, the liquid consumption apparatus 12 includes a carriage 20 in which a liquid jet head 21 that discharges liquid for forming a print image is mounted, and a plurality of tanks 23 mounted on the carriage 20 inside the apparatus. The liquid supply system 10 of the first embodiment includes a plurality of liquid containers 11 described above, the carriage 20 of the liquid consumption apparatus 12, and the plurality of tanks 23, and supplies liquid in the tank 23 to the liquid jet head 21 of the liquid consumption apparatus 12. In the liquid supply system 10, the liquid in the tank 23 is replenished by an operation of filling with the liquid from the liquid container 11 by the user. Note that each of the plurality of liquid containers 11 corresponds to one of the plurality of tanks 23 and stores the same liquid stored in the corresponding tank 23. In the first embodiment, the shape or dimension of each of the plurality of liquid containers 11 is the same. Hereinafter, the configuration of the liquid consumption apparatus 12 will be described first, and then the liquid supply system 10 of the first embodiment will be described.

Figure 2:
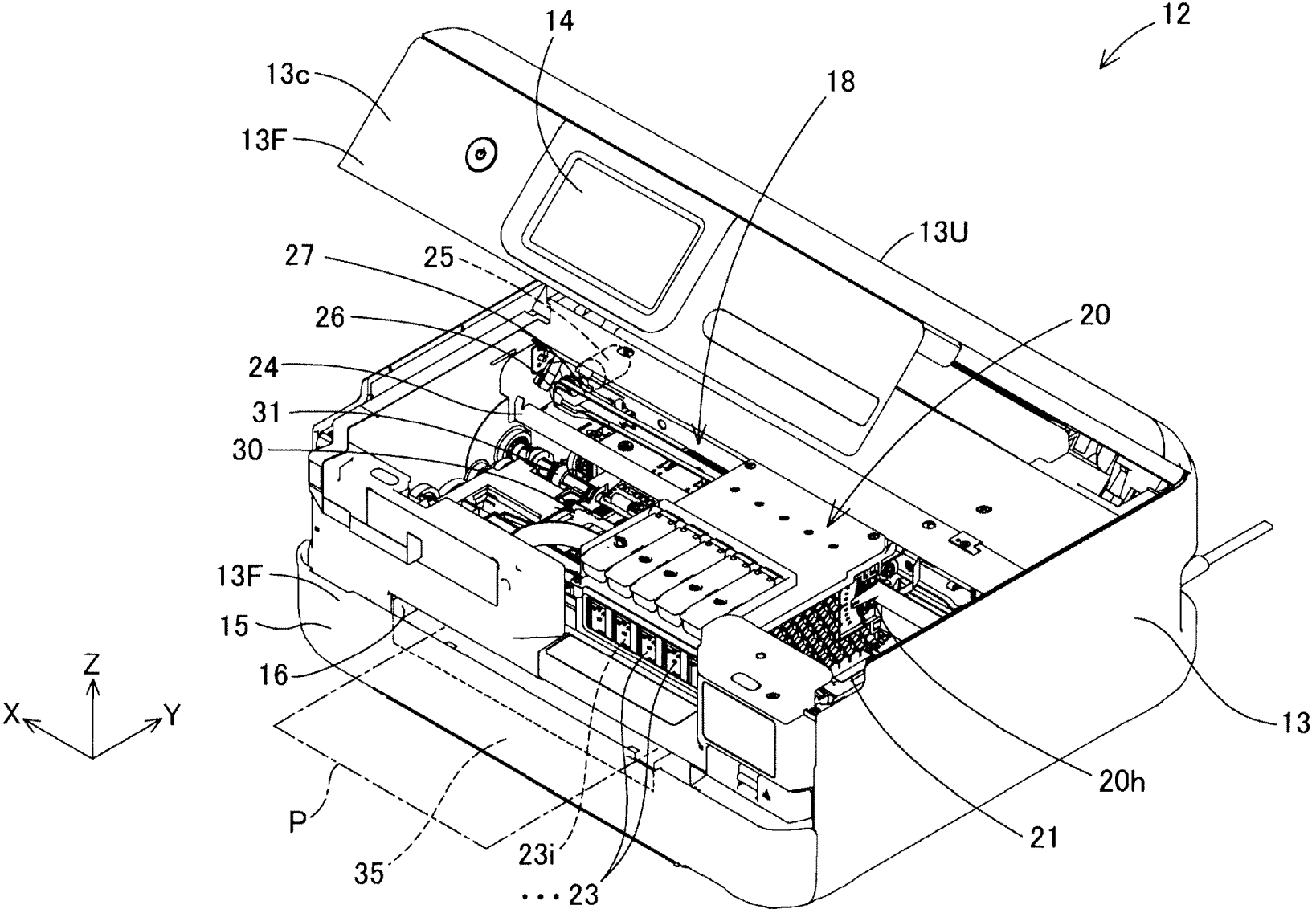
FIG. 2 is an outline view showing a configuration of a liquid consumption apparatus.

1-2. Configuration of Liquid Consumption Apparatus:

Make reference to FIGS. 1 and 2. FIG. 1 shows an outline perspective view of the liquid consumption apparatus 12 when a main body cover 13*c* is in a closed state. FIG. 2 shows an outline perspective view of the liquid consumption apparatus 12 when the main body cover 13*c* is opened and the apparatus is in a liquid replenish mode capable of filling the tank 23 with liquid from the liquid container 11.

FIGS. 1 and 2 show X, Y, and Z directions orthogonal to each other. The X, Y, and Z directions are directions associated with the liquid consumption apparatus 12 when in a posture disposed on a horizontal plane. The X direction is a direction that matches the left/right direction of the liquid consumption apparatus 12 and is parallel to the horizontal direction. Of the X directions, the +X direction is the left direction when facing the front side of the liquid consumption apparatus 12, and the −X direction is the right direction. The Y direction is a direction that matches the front/rear direction of the liquid consumption apparatus 12 and is parallel to the horizontal direction. Of the Y directions, the +Y direction is a direction from the front to the rear, and the −Y direction is a direction from the rear to the front. The Z direction is a direction that matches the up/down direction of the liquid consumption apparatus 12 and is parallel to the vertical direction. Of the Z directions, the +Z direction is an up direction, and the −Z direction is a down direction. In each of the views to be referred to later, the X, Y, and Z directions are shown so as to correspond to FIGS. 1 and 2.

Make reference to FIG. 1. The liquid consumption apparatus 12 includes a hollow housing 13 having a rectangular parallelepiped shape. On the front surface 13F of the housing 13, an interface section 14 for displaying information to a user and receiving an operation from the user is provided. Below the interface section 14 of the front surface 13F, a front surface cover member 15 is rotatably attached to the front side with the lower end as a supporting point. By rotating the front surface cover member 15 to the front side, an exhaust port 16 for exhausting the printing medium P is exposed to the outside.

The above-described main body cover 13*c* constitutes a part of the housing 13. The main body cover 13*c* constitutes an upper surface 13U of the housing 13 and an upper side portion of the front surface 13F. The interface section 14 described above is provided on the main body cover 13*c*. The main body cover 13*c* is opened and closed by rotating in the up/down direction by a hinge mechanism provided on a rear end side. When the main body cover 13*c* is rotated to the upper side and opened, as shown in FIG. 2, the internal structure of the liquid consumption apparatus 12 is exposed.

Make reference to FIG. 2. A printing mechanism 18 is provided inside the liquid consumption apparatus 12. The printing mechanism 18 includes the above-described carriage 20, a liquid jet head 21, and a plurality of tanks 23, and further includes a guide shaft 24, a driving motor 25, a pulley 26, and a timing belt 27 as a driving mechanism of the carriage 20.

Figure 7:
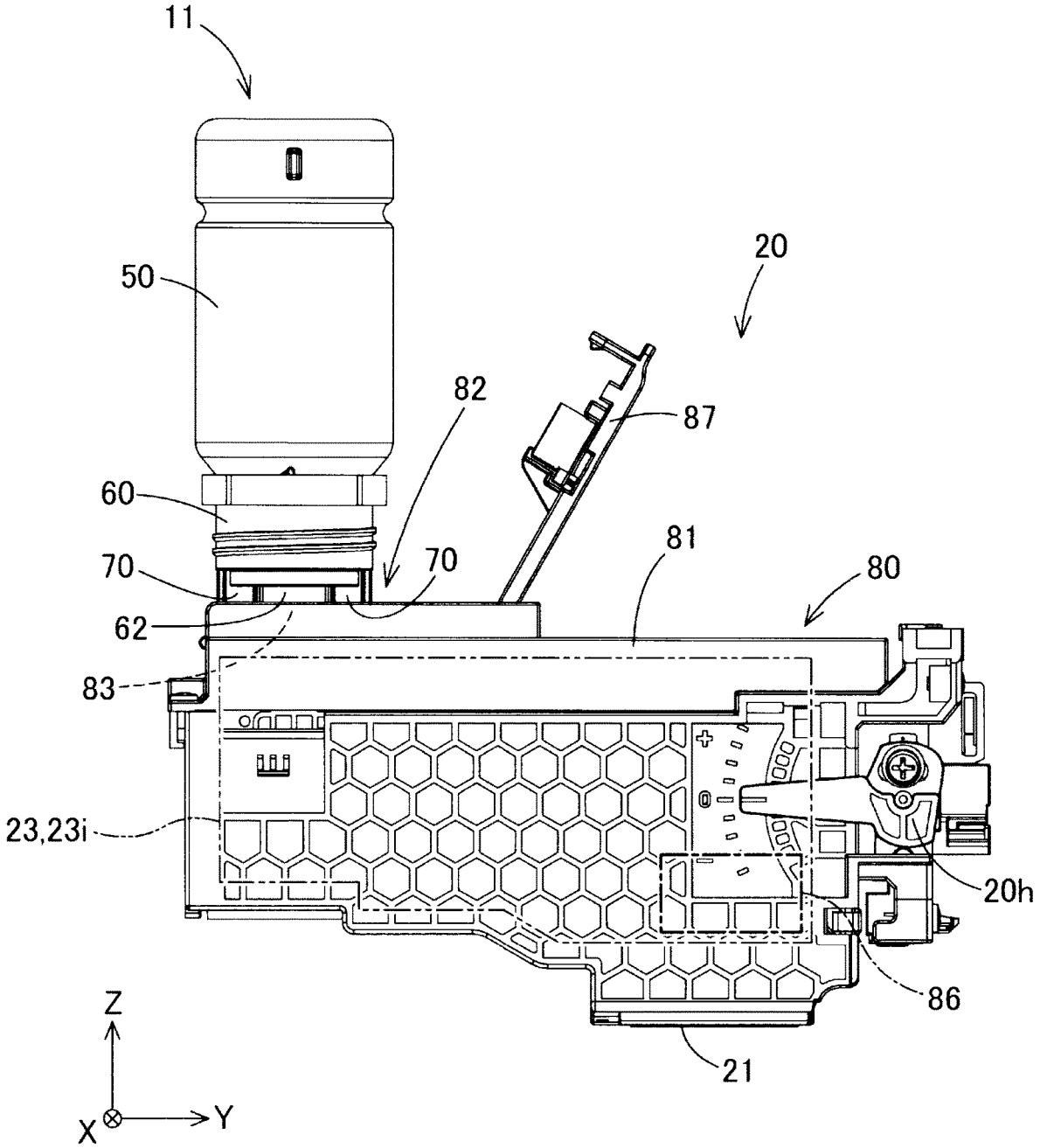
FIG. 7 is an outline side view showing a configuration of the carriage and the tank.

The liquid jet head 21 is provided on the lower surface of the carriage 20, as shown in FIG. 2 or FIG. 7 to be referred later. The liquid jet head 21 ejects the liquid toward the lower side from a nozzle (not shown) by a known method such as application of pressure to the liquid by a piezo element, for example.

In the first embodiment, the plurality of tanks 23 are arranged above the liquid jet head 21 on the carriage 20. In the first embodiment, the number of the plurality of tanks 23 is five, and the tank has a shape in which the Y direction is set as a longitudinal direction. The plurality of tanks 23 are mounted on the carriage 20 so as to be arranged in the X direction such that a liquid receiving section of each tank 23 to be described later is arranged on the front side of the carriage. Each tank 23 has a storing section 23*i* for storing liquid inside. Each tank 23 stores a different color ink. The plurality of tanks 23 are coupled to the liquid jet head 21 through a liquid supply path (not shown) provided in the carriage 20. At the time of the first use, the liquid stored in each tank 23 is sucked from each tank 23 to the above-described liquid supply path and supplied to the liquid jet head 21 by a pump (not shown) coupled to the liquid jet head 21 via a head cap (not shown). When using printing, the liquid is supplied from each tank 23 to the liquid jet head 21 as the liquid is consumed by discharging the liquid from the liquid jet head 21.

As described above, the carriage 20 and the plurality of tanks 23 constitute the liquid supply system 10, and each tank 23 is refilled by filling each tank 23 with liquid from the corresponding liquid container 11. The configuration of the liquid container 11, the detailed configuration of the carriage 20 and the tank 23, and the method of filling the tank 23 with the liquid from the liquid container 11 in the liquid supply system 10 will be described later.

The rear end of the carriage 20 is coupled to and supported by a guide shaft 24 that extends along the X direction. The carriage 20 can reciprocate along the guide shaft 24 in the +X direction and the −X direction. The carriage 20 is attached by a hinge mechanism 20*h* so as to be rotatable in the Z direction with the guide shaft 24 as a supporting point. Thereby the user can change the attachment angle of the carriage 20 with respect to the Y direction.

The pulleys 26 are provided behind both ends of the guide shaft 24. A timing belt 27 is wound around the pulley 26 along the guide shaft 24 behind the guide shaft 24. The carriage 20 is coupled to the timing belt 27. When the driving motor 25 rotates the pulley 26, the timing belt 27 rotates, and the carriage 20 moves along the guide shaft 24.

The printing mechanism 18 further includes a transporting path 30 for the printing medium P. The transporting path 30 is provided below the carriage 20 along the Y direction, and is coupled to the exhaust port 16. The printing medium P is transported in the −Y direction below the carriage 20 by the rotation of the transporting roller 31 provided on the transporting path 30, and is exhausted from the exhaust port 16. The printing medium P is stocked in a paper feed cassette 35 provided below the transporting path 30, and is fed to the transporting path 30 by a feeding mechanism (not shown).

When printing is performed by the liquid consumption apparatus 12, the printing medium P is transported by the transporting roller 31 on the transporting path 30 in the −Y direction, which is a sub-scanning direction. In the meantime, the liquid jet head 21 discharges the liquid toward the printing medium P while reciprocating with the carriage 20 in the ±X direction that is the main scanning direction with respect to the printing medium P on the transporting path 30. Thereby, ink dots are recorded on the printing surface of the printing medium P, and a printing image is formed. The printing medium P on which the printing image is formed is exhausted from the exhaust port 16.

The liquid consumption apparatus 12 enters a liquid replenish mode in response to a user operation through the interface section 14. In the liquid replenish mode, performing printing is prohibited, and the carriage 20 is moved to a predetermined position shown in FIG. 2. This position is a position where a user can visually check a later-described visual checking section of each tank 23 because a part of a wall section provided in front of the carriage 20 is cut away. After setting the liquid consumption apparatus 12 to the liquid replenish mode, the user can perform a filling operation for filling the tanks 23 with the liquid in the liquid container 11 by opening the main body cover 13*c* as shown in FIG. 2.

Figure 3:
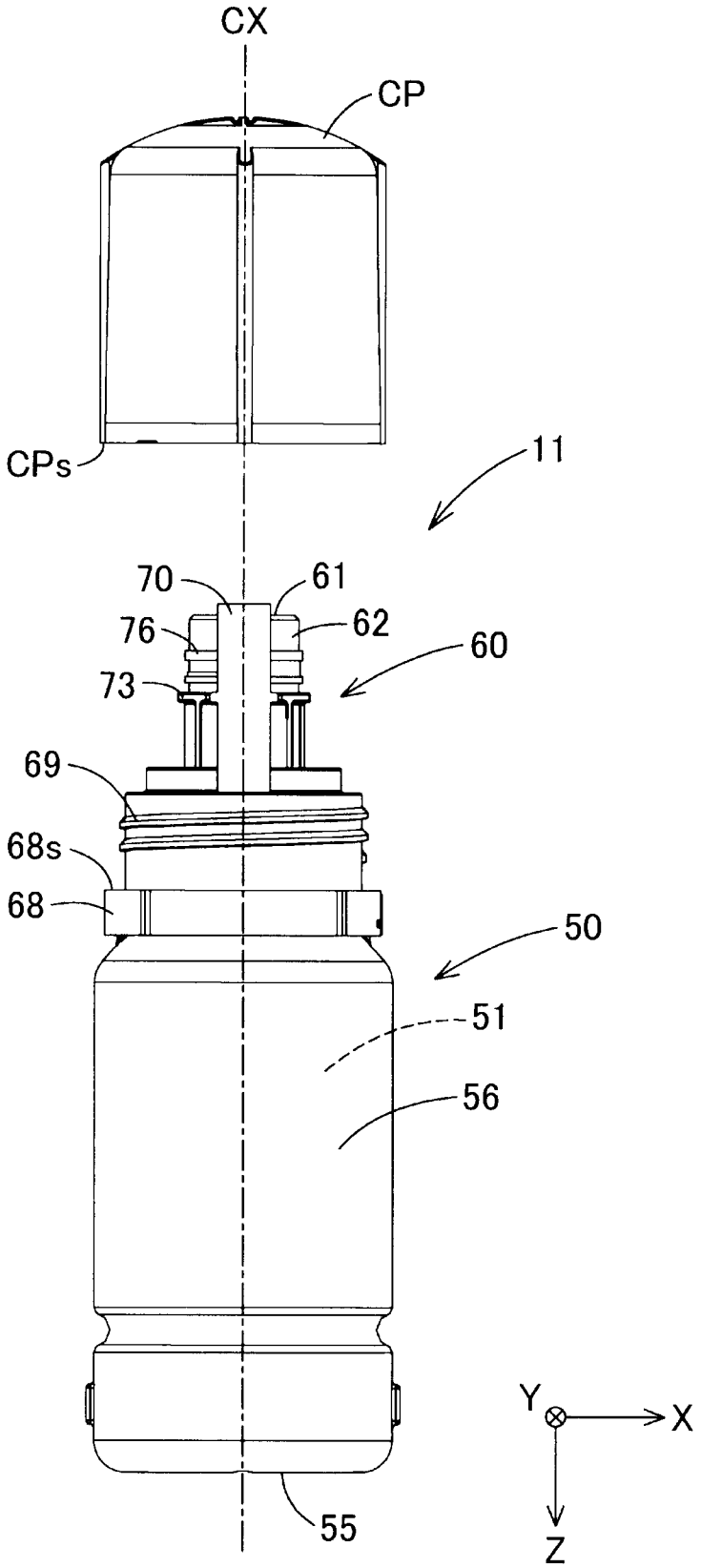
FIG. 3 is an outline side view showing a configuration of a liquid container of a first embodiment.
Figure 4:
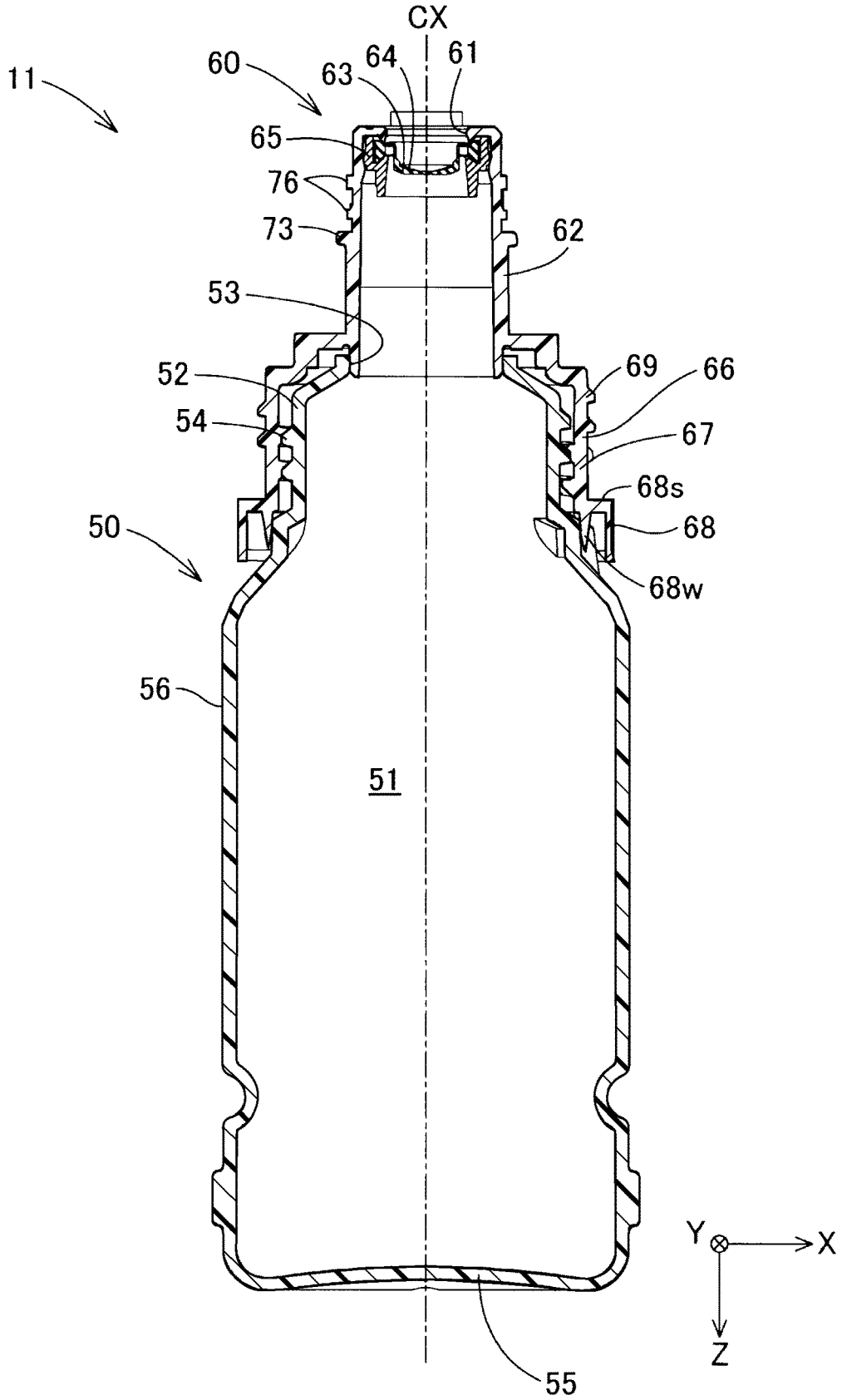
FIG. 4 is an outline cross-sectional view showing a configuration of the liquid container of the first embodiment.
Figure 5:
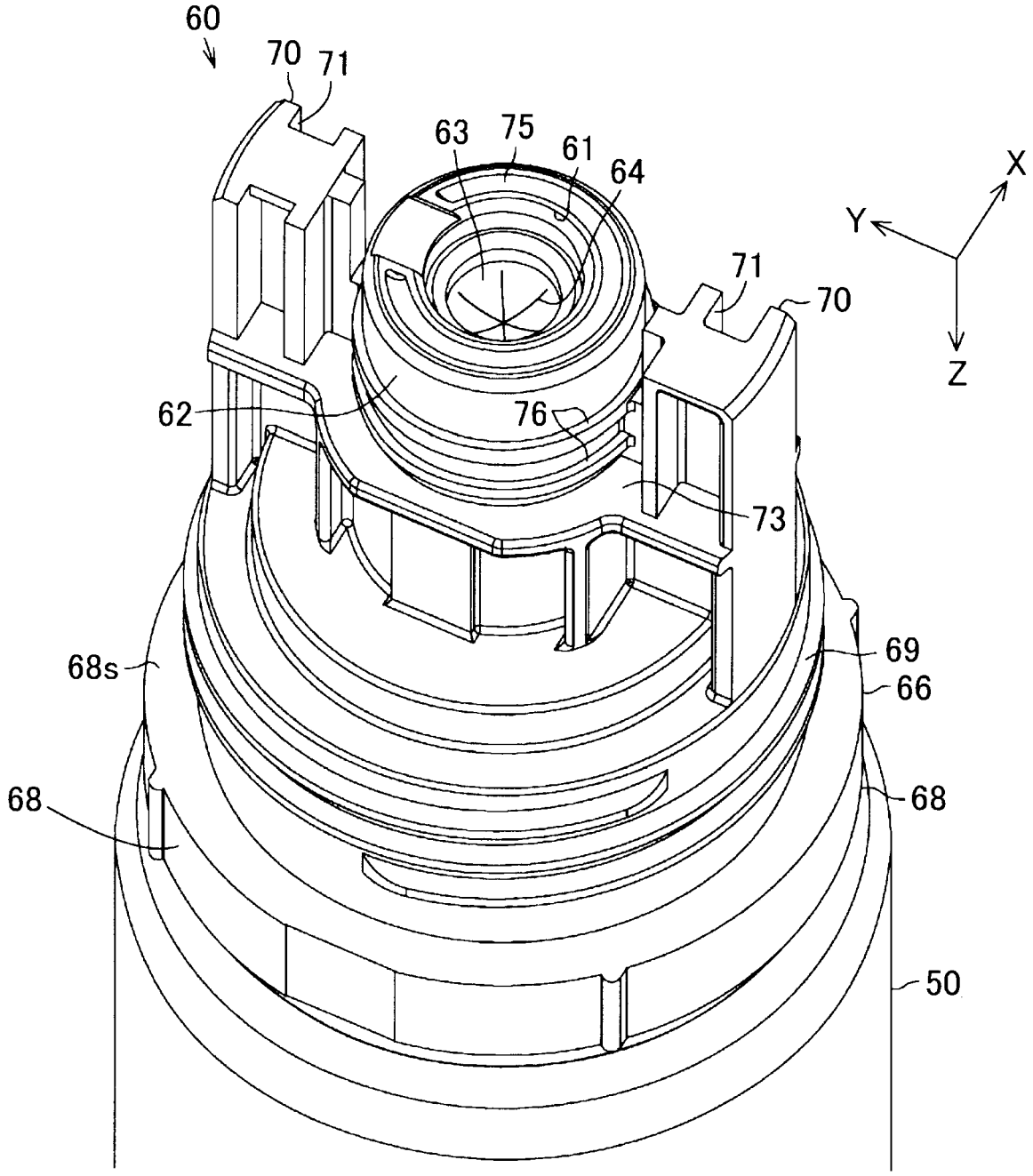
FIG. 5 is an outline perspective view showing a front end part of the liquid container of the first embodiment.

1-3. Configuration of Liquid Supply System:

1-3-1. Configuration of Liquid Container:

The configuration of the liquid container 11 of the first embodiment will be described with reference to FIGS. 3 to 5. FIG. 3 is an outline side view showing the liquid container 11 with the cap CP removed state. FIG. 4 is an outline cross-sectional view of the liquid container 11 taken along a cutting surface parallel to the paper surface in FIG. 3 through the central axis CX of the liquid outlet port 61 of the liquid container 11. FIG. 5 is an outline perspective view showing the liquid outlet port member 60 of the liquid container 11 in an enlarged manner. FIGS. 3 to 5 show the X, Y, and Z directions when the liquid container 11 is in a liquid filling posture described later so as to correspond to FIGS. 1 and 2.

Make reference to FIGS. 3 and 4. The liquid container 11 includes a container section 50 having an internal space 51 for storing liquid, and a liquid outlet port member 60 attached to an end section of the container section 50. Hereinafter, the end section of the liquid container 11 to which the liquid outlet port member 60 is attached is referred to as a "front end", and the opposite end section is also referred to as a "rear end". In the first embodiment, one end of the container section 50 in the direction of the central axis of the liquid container 11 is a "front end", and the other end is a "rear end". The central axis of the liquid container 11 is the central axis of the container section 50 that constitutes a main body section of the liquid container 11, and coincides with the central axis CX of the liquid outlet port 61 in the first embodiment.

In the first embodiment, the container section 50 is configured as a substantially cylindrical hollow member in which the central axis direction is set as a longitudinal direction. The container section 50 is made by, for example, blow molding of a resin material such as polypropylene (PP) or polyethylene terephthalate (PET). In addition to the liquid, a structure such as a frame member for suppressing deformation of the container section 50 due to an external force may be stored in the internal space 51 of the container section 50.

As shown in FIG. 4, on the front end side of the container section 50, a reduced diameter section 52 having a smaller diameter than the rear end side of the container section 50 is provided. An opening section 53 communicating with the internal space 51 is provided at the front end of the reduced diameter section 52. The liquid outlet port member 60 is attached to the container section 50 so as to cover the reduced diameter section 52. A male screw section 54 for fixing the liquid outlet port member 60 is provided on the outer peripheral side surface of the reduced diameter section 52.

A bottom wall section 55 that closes the internal space 51 is provided at the end section of the rear end side of the container section 50. The bottom wall section 55 is formed as a substantially planar wall section that intersects substantially perpendicularly with the central axis CX. Thereby, the liquid container 11 can be mounted on a horizontal surface in a posture with the front end side facing the upper side and the rear end side facing the lower side.

As shown in FIG. 3, a label 56 is attached to a side surface of the container section 50. The label 56 is made of, for example, a shrink film wound so as to be in close contact with the entire side surface of the container section 50. The label 56 displays information about the liquid container 11, such as the type of liquid stored in the liquid container 11 and the capacity of the liquid container 11. Note that the label 56 may be made of a paper seal attached to the side surface of the container section 50 with an adhesive instead of the shrink film.

The liquid outlet port member 60 is a member that functions as a so-called spout. As shown in FIG. 4, a liquid outlet port 61 that communicates with the internal space 51 of the container section 50 and allows the liquid in the internal space 51 to flow out is provided at the front end of the liquid outlet port member 60. As shown in FIGS. 4 and 5, in the first embodiment, the liquid outlet port member 60 is configured as a substantially cylindrical member in which a diameter gradually decreases toward the front end. In the first embodiment, the maximum width of the liquid outlet port member 60 in a direction orthogonal to the central axis CX is smaller than the maximum width of the container section 50 in the same direction. The liquid outlet port member 60 is made by, for example, injection molding of a resin material such as polypropylene or polyethylene terephthalate.

The liquid outlet port member 60 has a cylindrical conduit section 62 on the front end side. In the first embodiment, the cylindrical conduit section 62 has a cylindrical shape along the central axis CX of the liquid outlet port 61. As shown in FIG. 4, the above-described liquid outlet port 61 is provided at a front end of the cylindrical conduit section 62, and a rear end section of the cylindrical conduit section 62 is hermetically inserted into the opening section 53 of the container section 50.

Make reference to FIGS. 4 and 5. A valve body 63 that opens and closes the liquid outlet port 61 is attached to the liquid outlet port 61. The valve body 63 has a main body formed by elastic member such as a silicon film, and is disposed in the cylindrical conduit section 62 so as to close the liquid outlet port 61. In the center of the valve body 63, there is provided a slit 64 that opens and closes when the valve body 63 is elastically deformed in the thickness direction. Normally, the valve body 63 is in a state in which the slit 64 is airtightly closed, and suppresses the outflow of the liquid through the liquid outlet port 61. The valve body 63 allows the liquid to flow out through the liquid outlet port 61 by opening the slit 64 by coupling to a later-described liquid receiving section of the tank 23.

Make reference to FIG. 4. The valve body 63 is inserted from the rear end side of the cylindrical conduit section 62, and is fixed in a state where an outer peripheral edge section of the valve body 63 is in contact with a peripheral edge wall section of the liquid outlet port 61. An annular holding member 65 for fixing the valve body 63 is disposed in the cylindrical conduit section 62. The valve body 63 is held in a ring of the holding member 65. The holding member 65 is fixed in the cylindrical conduit section 62 in a state in which the outer peripheral edge section of the valve body 63 is pressed against the peripheral edge wall section of the liquid outlet port 61 by a peripheral step section protruding toward the center in the ring of the holding member 65.

Make reference to FIGS. 3 and 4. The liquid outlet port member 60 has, at the rear end side, a cylindrical attaching section 66 having a larger diameter than the liquid outlet port 61. As shown in FIG. 4, the reduced diameter section 52 of the container section 50 is stored in the internal space of the attaching section 66. On the inner peripheral surface of the attaching section 66, a female screw section 67 that is screwed to the male screw section 54 of the reduced diameter section 52 of the container section 50 is provided. The rear end section of the above-described cylindrical conduit section 62 protrudes into the internal space of the attaching section 66, and is coupled to the opening section 53 of the container section 50 inside the attaching section 66. At the rear end section of the attaching section 66, a large diameter section 68 having the largest diameter in the attaching section 66 is provided. As shown in FIG. 4, a ratchet 68*w* for preventing rotation is provided inside the large diameter section 68. After the liquid outlet port member 60 is attached to the container section 50 by screwing the male screw section 54 and the female screw section 67, the ratchet 68*w* prevents the liquid outlet port member 60 from rotating in the opposite direction to that when the liquid outlet port member 60 is attached to the container section 50 and loosening or disengaging the liquid outlet port member 60, thereby preventing liquid from leaking from the container section 50.

A male screw section 69 for fixing the cap CP shown in FIG. 3 to the liquid container 11 in a detachable state is provided on the outer peripheral side surface of the attaching section 66. On the inner peripheral surface of the cap CP, a female screw section (not shown) screwed to the male screw section 69 is formed. In the cap CP, a projection section (not shown) that protrudes so as to seal the liquid outlet port 61 is provided. When the cap CP is attached to the liquid container 11, the end surface CPs of the peripheral edge of the opening section of the cap CP is in contact with the upper surface 68*s* facing the front end side of the large diameter section 68. When the cap CP is attached to the front end section of the liquid container 11 when not used, leakage of the liquid from the container section 50 and fixation of the liquid at the peripheral edge of the liquid outlet port 61 due to drying of the liquid are suppressed.

Make reference to FIG. 5. The liquid outlet port member 60 further includes a pair of rectangular structure sections 70 that sandwich the cylindrical conduit section 62 in the radial direction. The radial direction of the cylindrical conduit section 62 means a direction orthogonal to the central axis of the cylindrical conduit section 62. In the first embodiment, the rectangular structure section 70 is formed as a substantially rectangular columnar portion along the cylindrical conduit section 62. The front end section of the rectangular structure section 70 is positioned at a position slightly higher than the front end section of the cylindrical conduit section 62, and the rear end section of the rectangular structure section 70 is coupled to the attaching section 66. Each of the pair of rectangular structure sections 70 is inserted into a rectangular hole section provided in an adapter section 82 described later that covers the tank 23. On the side surface of the rectangular structure section 70, a linear identification groove section 71 is provided from the front end side to the rear end side. The location where the identification groove section 71 is formed differs for each liquid container 11. The function of the identification groove section 71 will be described later.

The liquid outlet port member 60 further includes a position determining section 73 that is a platy portion that couples the cylindrical conduit section 62 and the rectangular structure section 70 to the cylindrical conduit section 62 in the radial direction. The position determining section 73 has an upper surface facing the front end side and along the cylindrical conduit section 62 in the radial direction. The function of the position determining section 73 will be described later.

A groove section 75 is formed along the outer periphery of the liquid outlet port 61 on an end surface on the front end side of the cylindrical conduit section 62. By having the groove section 75, after filling the tank 23 with the liquid, the liquid adhering to the peripheral edge of the liquid outlet port 61 can flow into the groove section 75 and be stored before dripping on the side surface of the cylindrical conduit section 62. Therefore, the liquid adhering to the peripheral edge of the liquid outlet port 61 is prevented from dripping on the side surface of the cylindrical conduit section 62.

On the outer peripheral side surface of the cylindrical conduit section 62, an annular projection section 76 protruding in the radial direction of the cylindrical conduit section 62 and formed along the outer periphery of the cylindrical conduit section 62 is provided. The annular projection section 76 can prevent the liquid spilled from the liquid outlet port 61 to the side surface of the cylindrical conduit section 62 from flowing along the side surface of the cylindrical conduit section 62 to the rear end side.

Figure 6:
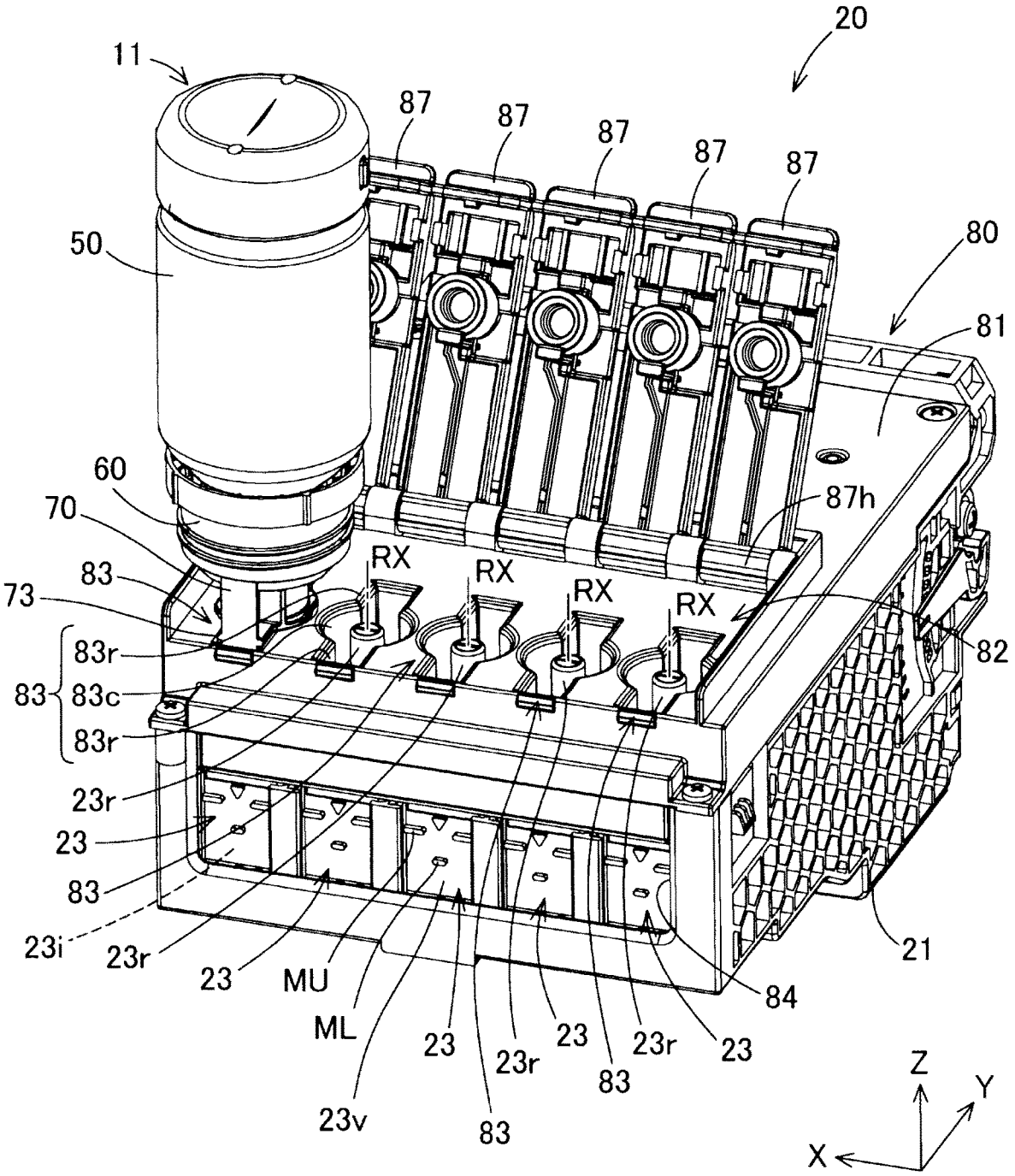
FIG. 6 is an outline perspective view showing a configuration of a carriage and a tank.
Figure 8:
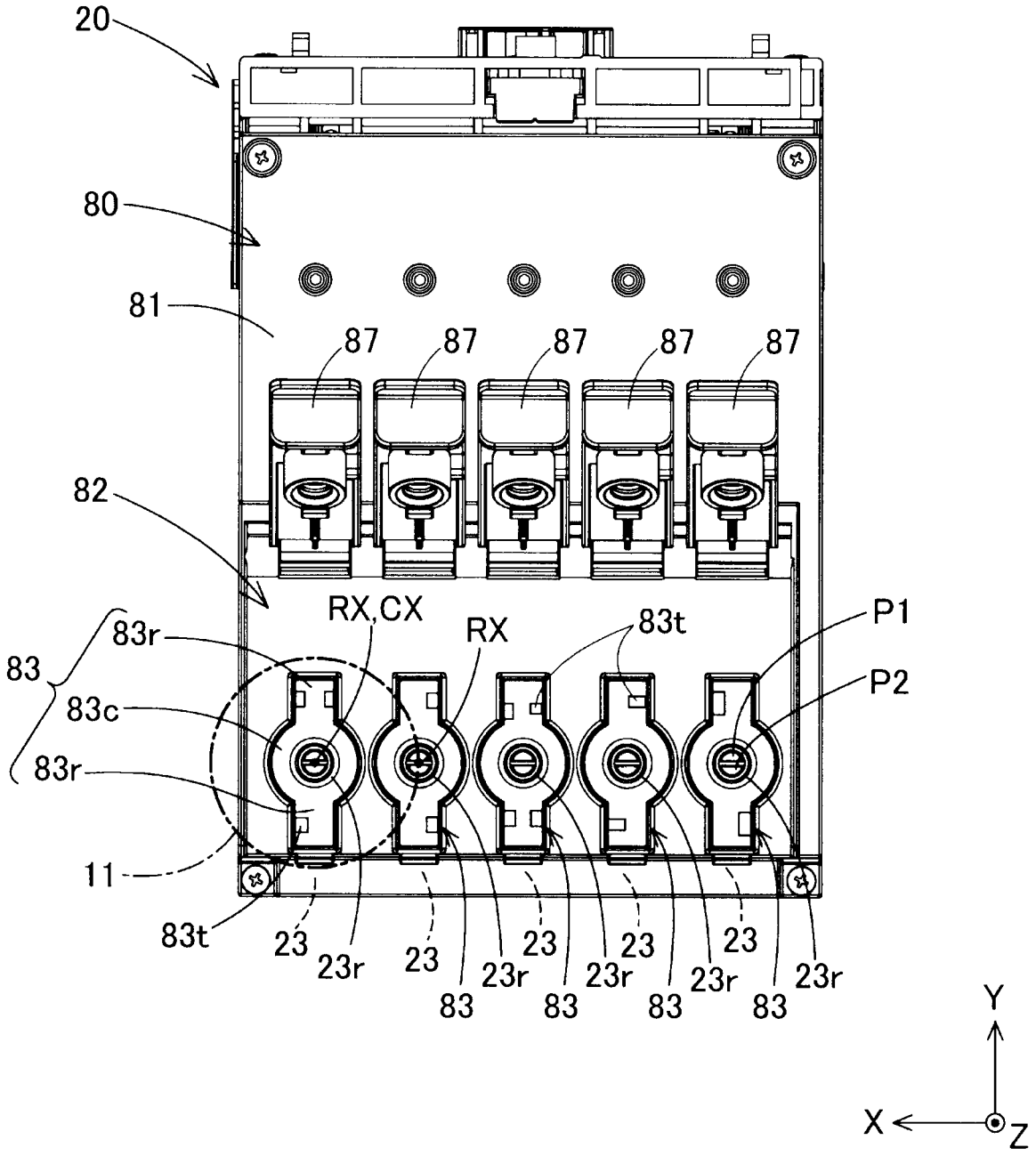
FIG. 8 is an outline plan view showing a configuration of the carriage and the tank.

1-3-2. Configuration of Carriage and Tank:

FIG. 6 is an outline perspective view showing a configuration of the carriage 20. FIG. 7 is an outline side view when the carriage 20 is viewed in the +X direction. FIG. 8 is an outline plan view when the carriage 20 is viewed in the −Z direction. FIGS. 6 and 7 show the liquid container 11 when filling the tank 23 with liquid. In FIG. 8, the disposition region of the liquid container 11 when filling the tank 23 with the liquid is shown by a dashed line.

Make reference to FIG. 6. The carriage 20 has a hollow exterior section 80 having a substantially rectangular parallelepiped shape. The exterior section 80 stores a liquid discharging mechanism (not shown) for discharging liquid from the plurality of tanks 23 or the liquid jet head 21 inside. As shown in FIG. 7, the liquid jet head 21 is attached to a position closer to the rear end side on the bottom surface of the exterior section 80.

The exterior section 80 has an upper surface cover 81 that covers the upper surface of each tank 23. The upper surface cover 81 is provided with an adapter section 82 for receiving the mounting of the liquid container 11. The adapter section 82 is provided at a position closer to the front of the carriage 20. The adapter section 82 has a plurality of container receiving sections 83. The container receiving sections 83 are constituted by through holes penetrating the upper surface cover 81, and are provided one above each tank 23. The container receiving section 83 receives the insertion of the front end part of the liquid outlet port member 60 provided in the liquid container 11 corresponding to each tank 23.

As shown in FIG. 8, the container receiving section 83 has an opening shape in which a pair of rectangular hole sections 83*r* having a substantially rectangular opening cross section is coupled front/rear a circular hole section 83*c* having a substantially circular opening cross section. The cylindrical conduit section 62 of the liquid container 11 is inserted into the circular hole section 83*c*, and the pair of rectangular structure sections 70 of the liquid container 11 are inserted into the pair of rectangular hole sections 83*r*.

The liquid receiving section 23*r* of each tank 23 is disposed at the center of the circular hole section 83*c*. The liquid receiving section 23*r* is formed by a cylindrical conduit that communicates with the storing section 23*i* of the tank 23 and that receives a liquid filling from the outside into the storing section 23*i*. FIGS. 6 and 8 show the central axis RX of the liquid receiving section 23*r* for convenience. As shown in FIG. 6, the liquid receiving section 23*r* extends vertically toward the upper side from the upper end of the tank 23 into the circular hole section 83*c*. In the first embodiment, each liquid receiving section 23*r* is arranged at a substantially equal interval in the X direction. When filling the tank 23 with the liquid from the liquid container 11, the cylindrical conduit section 62 of the liquid container 11 is inserted into the circular hole section 83*c*, and the liquid receiving section 23*r* in the circular hole section 83*c* is inserted into the liquid outlet port 61 of the liquid container 11.

Make reference to FIG. 8. The liquid receiving section 23*r* has two parallel flow paths P1 and P2 that communicate with the storing section 23*i* of the tank 23. The opening shapes of the first flow path P1 and the second flow path P2 have a shape obtained by dividing one circle into two semicircles. The first flow path P1 is provided behind the second flow path P2. The functions of the first flow path P1 and the second flow path P2 will be described later.

In the rectangular hole section 83*r*, there is provided an identification projection section 83*t* that protrudes in a rectangular shape from the inner side surface of the rectangular hole section 83*r*. The identification projection section 83*t* is inserted into the identification groove section 71 of the rectangular structure section 70 when the rectangular structure section 70 of the liquid container 11 is inserted into the rectangular hole section 83*r*. The formation position of the identification projection section 83*t* in the rectangular hole section 83*r* differs for each tank 23. The identification groove section 71 of the liquid container 11 is provided at a position according to the formation position of the corresponding identification projection section 83*t* of the tank 23. Thereby, the front end section of the liquid container 11 not corresponding to the tank 23 is prevented from being inserted into the container receiving section 83. Note that the same color as the color ink stored in the corresponding tank 23 may be applied or labeled as a mark on the upper surface of the adapter section 82 around the container receiving section 83.

In the first embodiment, when the insertion of the front end of the liquid outlet port member 60 in the liquid container 11 into the container receiving section 83 is received, the liquid container 11 is set to a predetermined liquid filling posture shown in FIGS. 6 and 7, and is able to fill the tank 23 with the liquid. In this liquid filling posture, as shown in FIG. 6, the front end side of the liquid container 11 is positioned on the −Z direction side, and the rear end side is positioned on the +Z direction side. Further, as shown in FIG. 8, the central axis CX of the liquid outlet port 61 of the liquid container 11 is positioned on the central axis RX of the liquid receiving section 23*r* of the tank 23. Further, in the first embodiment, as described above, when insertion of the pair of rectangular structure sections 70 of the liquid outlet port member 60 into the corresponding rectangular hole sections 83*r* is received, the liquid container 11 can fill the corresponding tank 23 with liquid. That is, the liquid filling posture of the liquid container 11 in the first embodiment is a posture in which the angle around the central axis CX of the liquid outlet port 61 is a predetermined angle. More specifically, the liquid filling posture of the liquid container 11 in the first embodiment is a posture in which the angle around the central axis CX of the liquid outlet port 61 is an angle at which the pair of rectangular structure sections 70 are arranged in the Y direction. The mechanism of filling the tank 23 with the liquid through the liquid outlet port 61 and the liquid receiving section 23*r* when the liquid container 11 is set to the liquid filling posture will be described later in detail.

In the first embodiment, the liquid container 11 is configured so as to self-stand on the tank 23 in the liquid filling posture by the front end of the liquid outlet port member 60 being fitted and supported in the container receiving section 83 as described below. The diameter of the cylindrical conduit section 62 of the liquid outlet port member 60 is substantially equal to the diameter of the circular hole section 83*c* of the container receiving section 83. When inserted into the circular hole section 83*c*, the cylindrical conduit section 62 is determined to be positioned in a state where the outer peripheral side surface is in contact with the inner peripheral side surface of the circular hole section 83*c*. The width of each rectangular structure section 70 of the liquid outlet port member 60 in the X direction is substantially equal to the width of the corresponding rectangular hole section 83*r* of the container receiving section 83 in the X direction. When inserted into the corresponding rectangular hole section 83*r*, each rectangular structure section 70 is determined to be positioned in a state where the side surface contacts the inner wall surface of the rectangular hole section 83*r* in the X direction. In addition, in the first embodiment, when the liquid container 11 is in the liquid filling posture, the peripheral edge section of the position determining section 73 of the liquid outlet port member 60 contacts and is supported by the outer peripheral edge section of the container receiving section 83, and the liquid container 11 is determined to be positioned in the −Z direction. As described above, since the movement of the liquid outlet port member 60 is regulated by the engagement of the front end of the liquid outlet port member 60 with the container receiving section 83, the liquid container 11 is supported by the adapter section 82, maintains the liquid filling posture, and self-stands on the tank 23. According to the liquid supply system 10 of the first embodiment, since the liquid container 11 fills the tank 23 with liquid in a state where the liquid container 11 self-stands on the tank 23, the liquid replenishing operation on the tank 23 is facilitated.

In the liquid supply system 10, when one liquid container 11 is coupled to the liquid receiving section 23*r* of the corresponding tank 23 with the liquid filling posture and fills the tanks 23 with the liquid, the coupling of the liquid container 11 to the adjacent liquid receiving section 23*r* is restricted. The reason will be described later.

Make reference to FIG. 6. The exterior section 80 of the carriage 20 has an opening window section 84 which is a through hole for exposing a part of each tank 23 to the outside on the front surface wall section. The opening window section 84 has a rectangular shape in which the X direction is set to the longitudinal direction. The front surface wall section of each tank 23 is provided with a visual checking section 23*v* that allows a user to visually check the position of the liquid level in the storing section 23*i* through the opening window section 84. The front surface wall section of the tank 23 constituting the visual checking section 23*v* is made of a transparent or translucent resin. In the storing section 23*i*, an upper limit mark MU indicating the upper limit standard of the liquid level and a lower limit mark ML indicating the lower limit standard of the liquid level are written on the visual checking section 23*v*. The upper limit mark MU indicates, for example, an upper limit position of the liquid level at which the liquid is not expected to overflow from the liquid receiving section 23*r* when the liquid filling is performed from the liquid container 11. The lower limit mark ML indicates, for example, a lower limit position of the liquid level that prompts a user to replenish the tank 23 with liquid. According to the liquid supply system 10 of the first embodiment, the user can fill the tank 23 with the liquid from the liquid container 11 while checking the amount of the liquid in the tank 23 through the visual checking section 23*v*. Therefore, when performing an operation of replenishing the tank 23 with the liquid from the liquid container 11, the liquid is prevented from overflowing from the liquid receiving section 23*r*.

Make reference to FIG. 7. In each tank 23, a sensor member 86 constituting a remaining amount sensor for detecting the remaining amount of the liquid stored in the storing section 23*i* is provided in the storing section 23*i*. In FIG. 7, for convenience, an example of a disposition position of the sensor member 86 is shown by a dashed line. The sensor member 86 is provided at a position closer to the rear end and at a position closer to the lower end of the tank 23. The sensor member 86 is, for example, a prism that transmits light emitted from a light emitting element provided behind the tank 23 in order to optically detect the liquid in the storing section 23*i*. When the remaining amount sensor is configured to electrically detect the liquid in the storing section 23*i*, it is assumed that the sensor member 86 is an electrode pin that is inserted into the storing section 23*i* from behind the tank 23 and contacts the liquid. Since the liquid supply system 10 of the first embodiment has the remaining amount sensor that detects the remaining amount of the liquid in each tank 23, it is possible to suppress a situation in which the liquid in each tank 23 runs short while printing is performed. In another embodiment, the sensor member 86 may be configured with an optical sensor that emits light to a prism disposed on the bottom surface of the tank 23. In this case, the sensor member 86 may be disposed on the inner bottom section of the liquid consumption apparatus 12, for example, around the platen.

Make reference to FIG. 6. A plurality of lid members 87 for sealing each of the plurality of container receiving sections 83 are provided on an upper surface cover 81 included in the exterior section 80 of the carriage 20. The lid member 87 is formed of a platy member, and the lower end of the lid member 87 is rotatably coupled to the upper surface of the upper surface cover 81 via a hinge mechanism 87*h*. The lid member 87 is normally closed so as to cover the container receiving section 83, as shown in FIG. 2, and hermetically seals the liquid receiving section 23*r* in the container receiving section 83. When filling the tank 23 with the liquid from the liquid receiving section 23*r*, by rotating the lid member 87 toward the upper side, as shown in FIG. 6, the container receiving section 83 and the liquid receiving section 23*r* are opened. Although FIG. 6 illustrates a state in which all the lid members 87 are opened, in practice, only the lid member 87 corresponding to the tank 23 in which the liquid filling is performed may be opened. According to the liquid supply system 10 of the first embodiment, the lid member 87 provided on the carriage 20 can suppress leakage of liquid or evaporation of liquid from the liquid receiving section 23*r* of each tank 23.

Figure 9A:
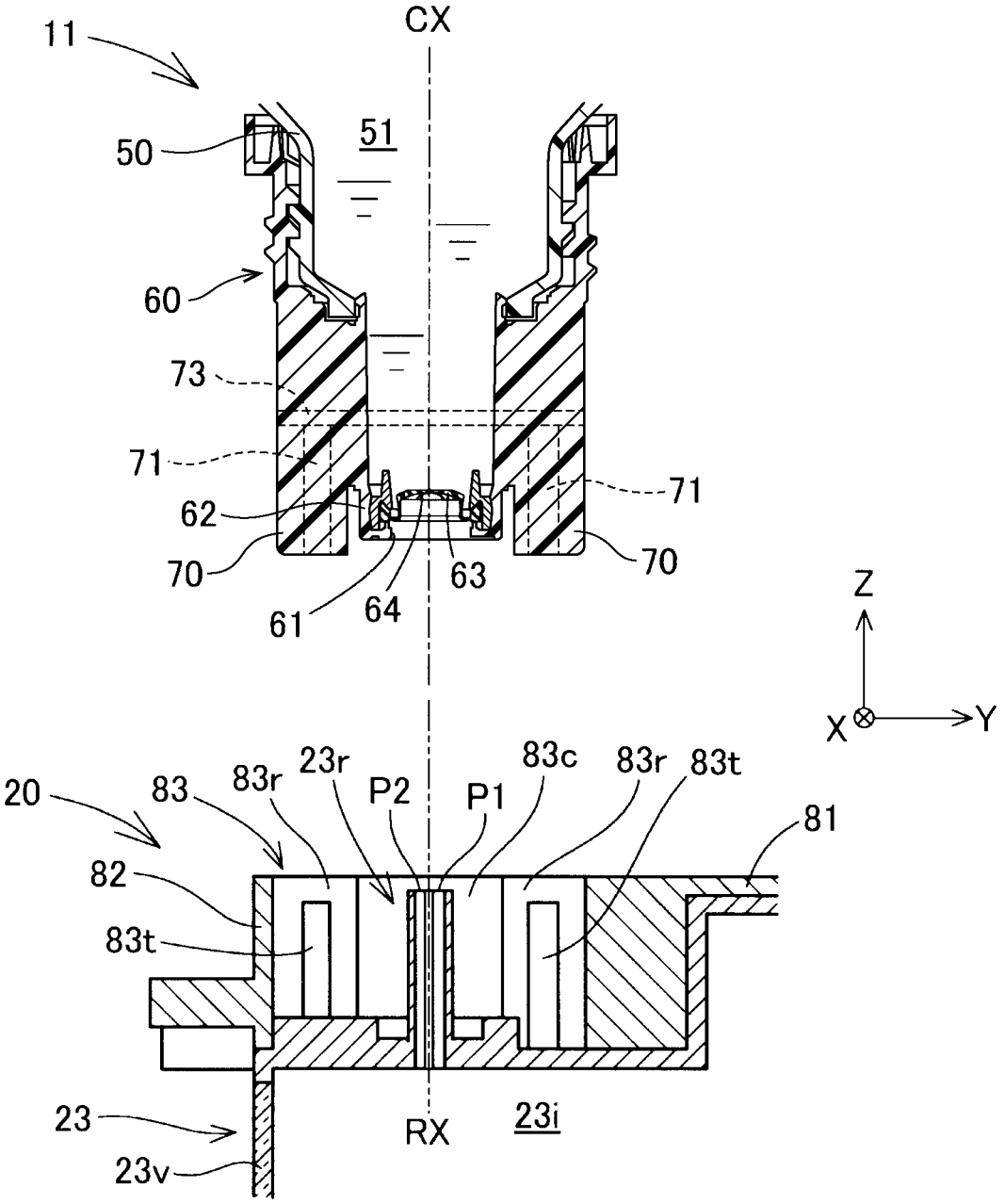
FIG. 9A is a first schematic view showing a process of filling a tank with liquid.
Figure 9B:
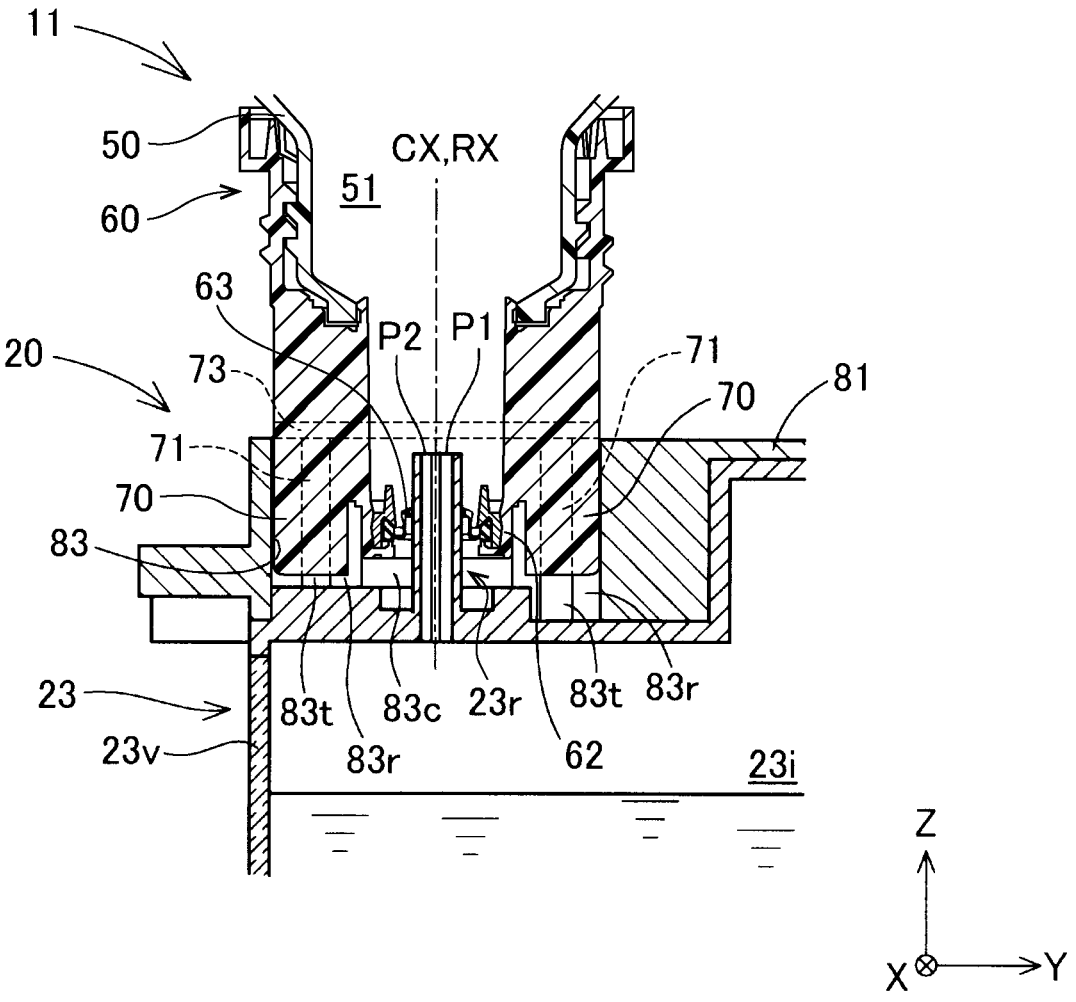
FIG. 9B is a second schematic view showing a process of filling the tank with liquid.

1-3-3. Filling the Tank with Liquid:

FIGS. 9A and 9B are schematic views showing a process of filling a tank 23 with a liquid from a liquid container 11. FIGS. 9A and 9B respectively show an outline cross-sectional view of the upper end part of the carriage 20 and the front end part of the liquid container 11. FIG. 9A shows a stage before the liquid outlet port member 60 of the liquid container 11 is coupled to the container receiving section 83 of the adapter section 82, and FIG. 9B shows a stage after the liquid outlet port member 60 of the liquid container 11 is coupled to the container receiving section 83 of the adapter section 82.

Make reference to FIG. 9A. First, a user turns the front end of the liquid outlet port member 60 of the liquid container 11 toward the lower side, makes the liquid outlet port 61 face the liquid receiving section 23*r* above the corresponding container receiving section 83 of the tank 23, and positions the central axis CX of the liquid outlet port 61 on the central axis RX of the liquid receiving section 23*r*. Further, the user positions each of the pair of rectangular structure sections 70 of the liquid container 11 on the corresponding rectangular hole sections 83*r*. Note that at this time, since the valve body 63 is in a closed state in which the slit 64 is closed, the outflow of the liquid from the liquid outlet port 61 is suppressed.

Next, the user moves the front end of the liquid outlet port member 60 of the liquid container 11 toward the container receiving section 83 on the lower side. Thereby, the cylindrical conduit section 62 of the liquid outlet port member 60 is inserted into the circular hole section 83*c* of the adapter section 82, and each rectangular structure section 70 is inserted into the corresponding rectangular hole section 83*r*. At this time, when the liquid container 11 is about to be coupled to the tank 23 with incompatible color ink, the identification projection section 83*t* in the rectangular hole section 83*r* is not inserted into the identification groove section 71, and interferes with the rectangular structure section 70 as described above. Therefore, the coupling of the liquid container 11 to the tank 23 which does not correspond is suppressed. As shown in FIG. 9B, the position determining section 73 of the liquid outlet port member 60 of the liquid container 11 is in contact with the outer peripheral edge section of the container receiving section 83, and the liquid outlet port member 60 of the liquid container 11 is determined to be positioned, so that the liquid container 11 is set to a liquid filling posture in which the coupling to the tank 23 is completed.

A mechanism for filling the tank 23 with the liquid from the liquid container 11 through the liquid outlet port 61 and the liquid receiving section 23*r* will be described. As shown in FIG. 9B, when the front end of the liquid outlet port member 60 is properly inserted into the container receiving section 83, the liquid receiving section 23*r* in the container receiving section 83 pushes and spreads the slit 64 of the valve body 63 and is inserted into the cylindrical conduit section 62. The liquid in the cylindrical conduit section 62 of the liquid container 11 starts to flow into the storing section 23*i* of the tank 23 through the first flow path P1 and the second flow path P2, and is pushed by the flowing liquid, thereby the pressure of the air in the storing section 23*i* increases. Although not shown, the lower end side of the second flow path P2 is formed to have a larger opening cross-sectional area than the upper end side of the second flow path P2. Thereby, while the liquid continues to flow in the first flow path P1, the second flow path P2 is pushed by the pressure of the air on the side of the storing section 23*i*, so that the liquid stops descending at an intermediate position such as a position where the cross-sectional area of the flow path changes, and starts to be pushed back to the container section 50 side. Therefore, the first flow path P1 functions as a liquid flow path, and the second flow path P2 functions as an air flow path. Accordingly, even if the user does not perform an operation such as squeezing with respect to the container section 50 of the liquid container 11, the liquid in the liquid container 11 and the atmosphere in the tank 23 are automatically exchanged, and the storing section 23*i* of the tank 23 is replenished with the liquid.

Note that in another embodiment, a portion having a large flow path cross-sectional area is provided at the lower end of the first flow path P1 so that the first flow path P1 may function as an air flow path, and the second flow path P2 may function as a liquid flow path.

Alternatively, in each of the flow paths P1 and P2, a portion where the flow path cross-sectional area becomes large may be omitted. Further, in another embodiment, the liquid receiving section 23*r* may be configured such that the opening end section of the first flow path P1 and the opening end section of the second flow path P2 are positioned stepwise up/down. In this case, usually, the flow path with the higher position of the opening end section is coupled to the cylindrical conduit section 62 first, and the liquid starts to flow first, and functions as a liquid flow path, and then the flow path with the lower position of the opening end section is coupled to the cylindrical conduit section 62 later, and the air flows in, and functions as an air flow path. However, in this configuration, for example, when the liquid container 11 is inclinedly coupled to the liquid receiving section 23*r* and the order of coupling of the flow paths P1 and P2 to the cylindrical conduit section 62 is switched, the functions of the liquid flow path and the air flow path may be switched between the two flow paths P1 and P2.

In addition, the lower end of the liquid receiving section 23*r* may be configured to be positioned near a predetermined upper limit position of the liquid level in the storing section 23*i*. According to this configuration, when the liquid level in the storing section 23*i* of the tank 23 exceeds the upper limit, the lower end of the liquid receiving section 23*r* is closed by the liquid. Therefore, the outflow of the gas from the tank 23 through the liquid receiving section 23*r* is stopped, the inflow of the liquid into the tank 23 is also stopped, the liquid filling operation is automatically stopped, and then the liquid is prevented from overflowing from the liquid receiving section 23*r*.

Figure 10A:
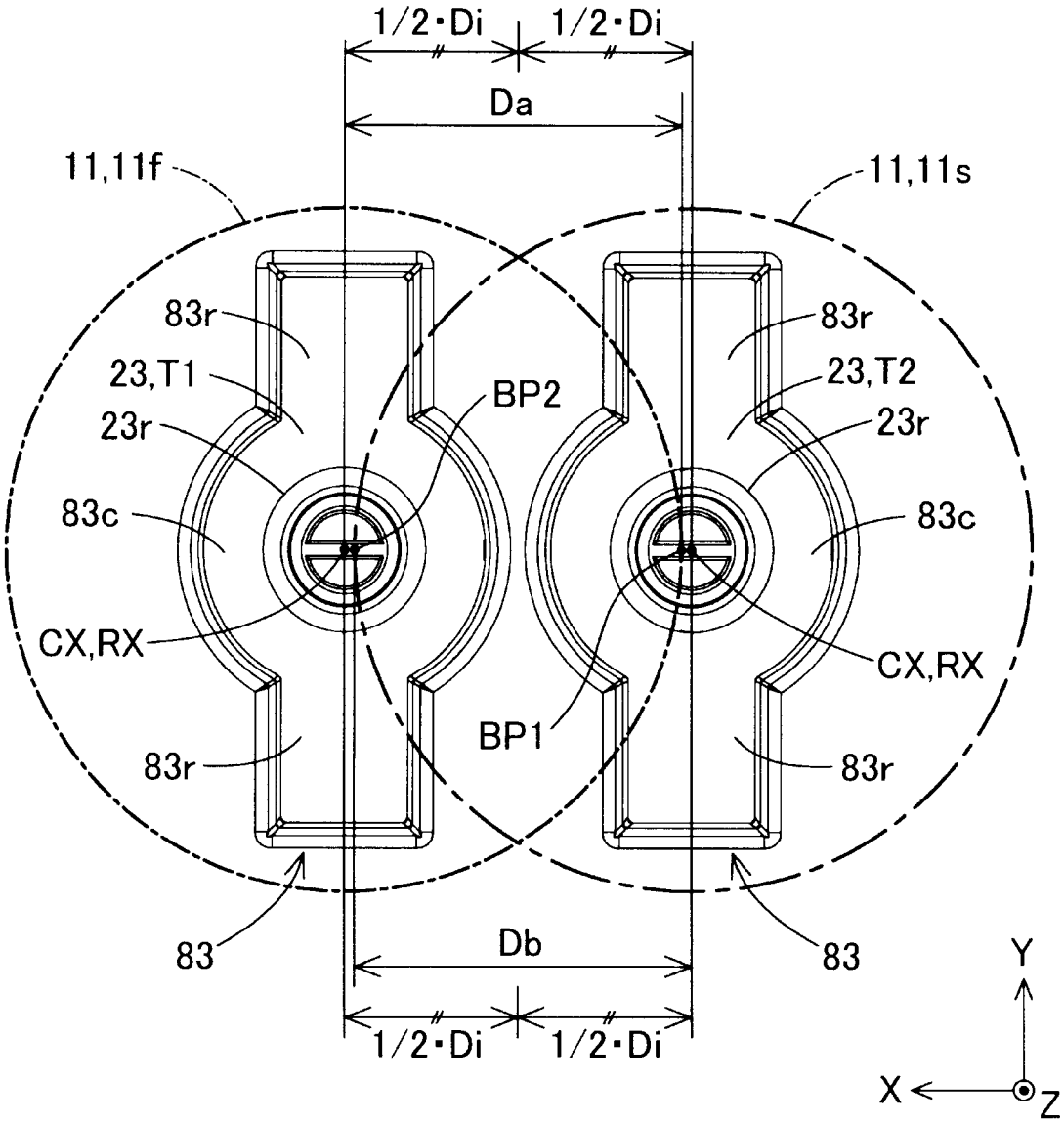
FIG. 10A is a schematic view showing disposition regions of two liquid containers having a liquid filling posture.

FIG. 10A is a schematic view when any two liquid receiving sections 23*r* adjacent to each other and container receiving sections 83 in the carriage 20 are viewed in the −Z direction. In FIG. 10A, disposition regions of the two liquid containers 11 coupled to the respective liquid receiving sections 23*r* and having the liquid filling posture are shown by a dashed line. The disposition region of the liquid container 11 shown in FIG. 10A corresponds to the outer peripheral contour line when the liquid container 11 having the liquid filling posture is viewed in the −Z direction.

Among the plurality of tanks 23, any two tanks 23 in which the liquid receiving sections 23*r* are disposed adjacent to each other on the carriage 20 are referred to as "first tank T1" and "second tank T2", respectively. Further, among the plurality of liquid containers 11, the liquid container 11 for the first tank T1 associated with filling the first tank T1 with liquid is referred to as a "first liquid container 11*f*", and the liquid container 11 for the second tank T2 associated with filling the second tank T2 with liquid is referred to as a "second liquid container 11*s*". Further, the liquid filling posture of the first liquid container 11*f* when filling the first tank T1 with the liquid is referred to as a "first tank filling posture", and the liquid filling posture of the second liquid container 11*s* when filling the second tank T2 with the liquid is referred to as a "second tank filling posture". Furthermore, a distance between the central axes RX of the liquid receiving sections 23*r* of the first tank T1 and the second tank T2 is denoted by Di.

At this time, a distance Da between the central axis CX of the liquid outlet port 61 of the first liquid container 11*f* and the portion BP1 of the first liquid container 11*f* closest to the central axis RX of the liquid receiving section 23*r* of the second tank T2 is longer than ½ of the distance Di. In the first embodiment, the maximum width of the first liquid container 11*f* when having the first tank filling posture in the X direction is twice as large as the distance Da, and is larger than the distance Di. Further, a distance Db between the central axis CX of the liquid outlet port 61 of the second liquid container 11*s* and the portion BP2 of the second liquid container 11*s* closest to the central axis RX of the liquid receiving section 23*r* of the first tank T1 is longer than ½ of the distance Di. Each of the distances Da and Db is a distance in the X direction, which is the arrangement direction of the liquid receiving section 23*r* of the first tank T1 and the liquid receiving section 23*r* of the second tank T2. Since such a relationship between the distances Di, Da, and Db is established, there are portions that overlap each other in the disposition regions of the two liquid containers 11*f* and 11*s* when each has the liquid filling posture.

Figure 10B:
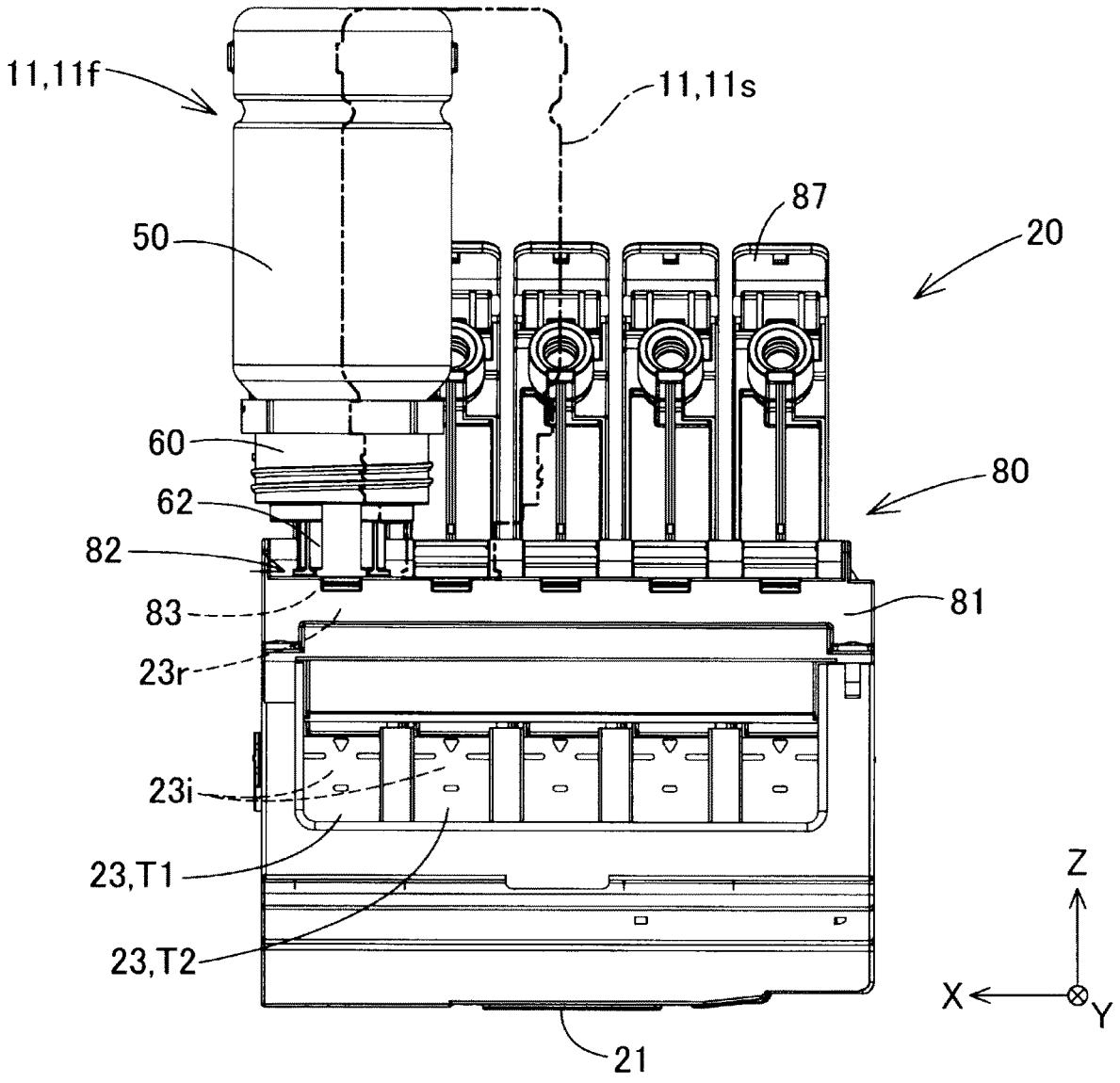
FIG. 10B is an outline front view showing the carriage when a first liquid container is coupled with the liquid filling posture.

FIG. 10B is an outline front view showing the carriage 20 when the first liquid container 11*f* is coupled with the first tank filling posture. FIG. 10B shows an example of the carriage 20 in which the tank 23 positioned at the end on the +X direction side is set to the first tank T1 and the adjacent tank 23 arranged on the −X direction side is set to the second tank T2. In FIG. 10B, the disposition region of the second liquid container 11*s* set to the second tank filling posture is shown by a dashed line. The disposition region of the liquid container 11 shown in FIG. 10B corresponds to the outer peripheral contour line when the second liquid container 11*s* having the second tank filling posture is viewed in the +Y direction.

In a case where the first liquid container 11*f* is set to the first tank filling posture when filling the first tank T1 with liquid, the first liquid container 11*f* has a portion that interferes with the disposition region of the second liquid container 11*s* having the second tank filling posture when filling the second tank T2 with the liquid. Therefore, when the first liquid container 11*f* is coupled to the carriage 20 with the first tank filling posture, coupling the second liquid container 11*s* to the liquid receiving section 23*r* of the second tank T2 with the second tank filling posture is hindered by the interference of the first liquid container 11*f*.

Figure 11:
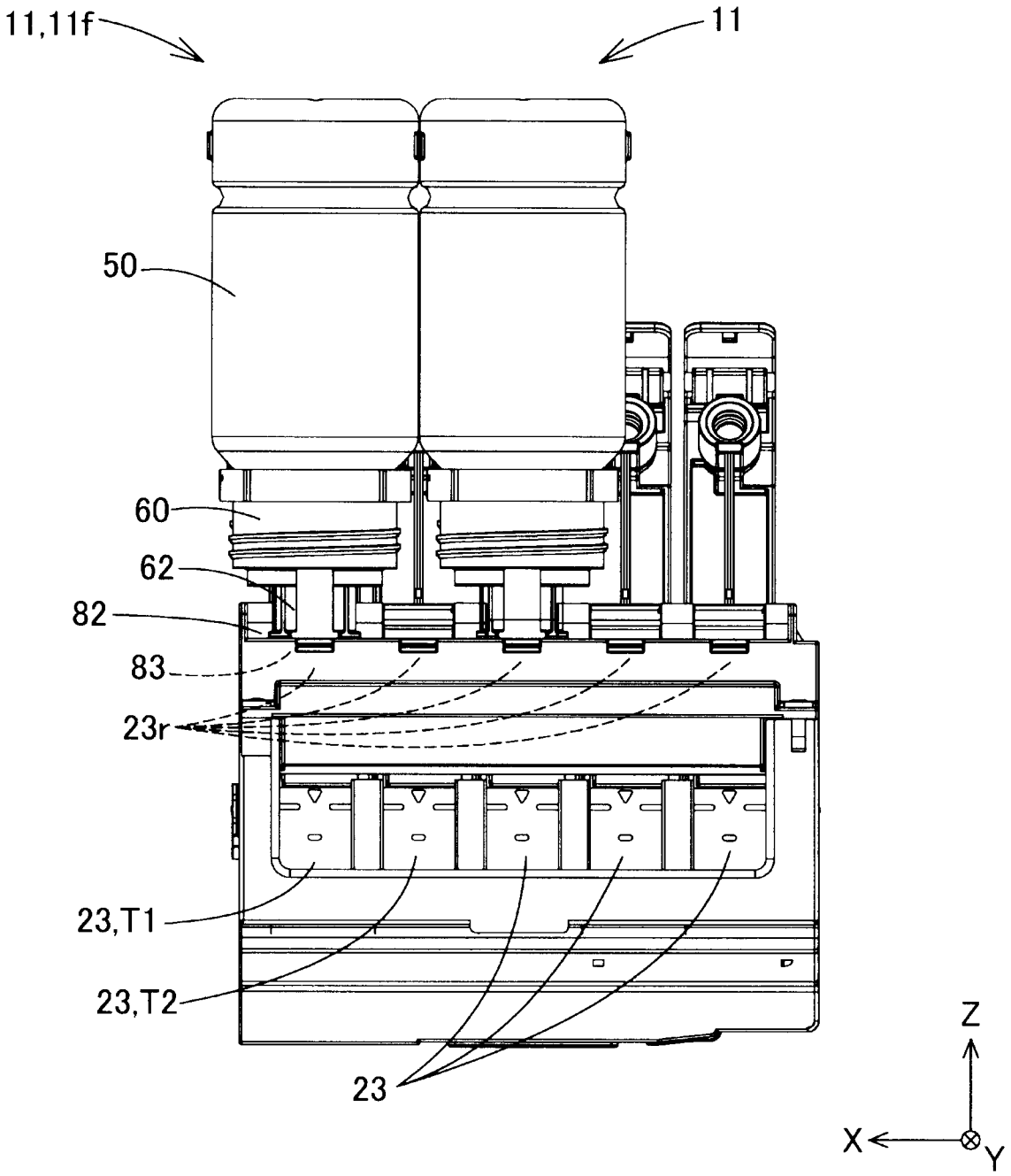
FIG. 11 is an outline front view showing the carriage when two liquid containers are coupled with the liquid filling posture.

FIG. 11 is an outline front view showing the carriage 20 when two liquid containers 11 are coupled with the liquid filling posture. Even in a state where the first liquid container 11*f* is coupled to the liquid receiving section 23*r* of the first tank T1 with the first tank filling posture, it is allowed to coupled the liquid container 11 to the liquid receiving section 23*r* of the remaining tank 23 other than the second tank T2 with the liquid filling posture.

As described above, according to the liquid supply system 10 of the first embodiment, it is difficult to simultaneously mount the liquid container 11 in an appropriate posture on the two liquid receiving sections 23*r* arranged adjacent to each other. Therefore, the number of liquid containers 11 that can be simultaneously coupled to the carriage 20 for filling the tank 23 with the liquid is limited. Therefore, a load due to the simultaneous coupling of a large number of liquid containers 11 is applied to the carriage 20, thereby the occurrence of a problem that the installation posture of the carriage 20 shifts or the carriage 20 is deformed is suppressed. Therefore, a decrease in the printing quality of the liquid consumption apparatus 12 due to a malfunction of the carriage 20 is suppressed.

Further, when the shift of the installation posture of the carriage 20 as described above is suppressed, the inclination of the tank 23 is suppressed, so that incorrect grasping of the liquid amount via the visual checking section 23*v* due to the inclination of the tank 23 is suppressed. Similarly, the inclination of the tank 23 prevents the sensor member 86 provided in the tank 23 from lowering the detection accuracy of the remaining amount of liquid.

In addition, since the number of liquid containers 11 that can be coupled to the carriage 20 is limited, a large number of liquid containers 11 are simultaneously coupled to the carriage 20, and a situation in which the management of the user becomes inadequate and a large number of the liquid containers 11 are left coupled to the carriage 20 is suppressed. Therefore, a situation where the liquid receiving section 23*r* is inserted into the slit 64 of the valve body 63 and left for a long time is suppressed, and in such a situation, the elastic force of the valve body 63 is reduced with time, so that the slit 64 is kept from being opened even after the liquid receiving section 23*r* is pulled out.

2. Second Embodiment

Figure 12A:
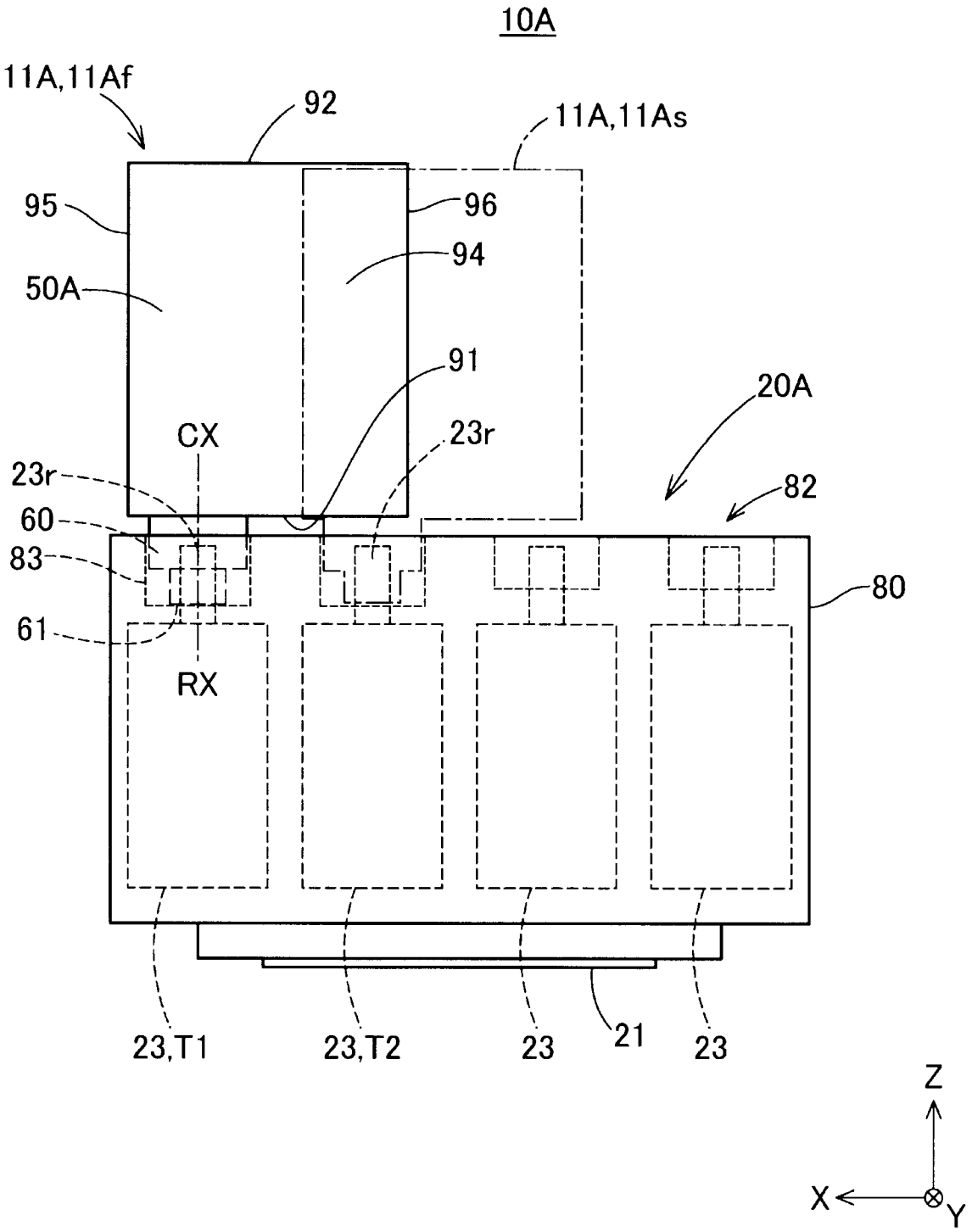
FIG. 12A is an outline front view schematically showing a carriage of a second embodiment.
Figure 12B:
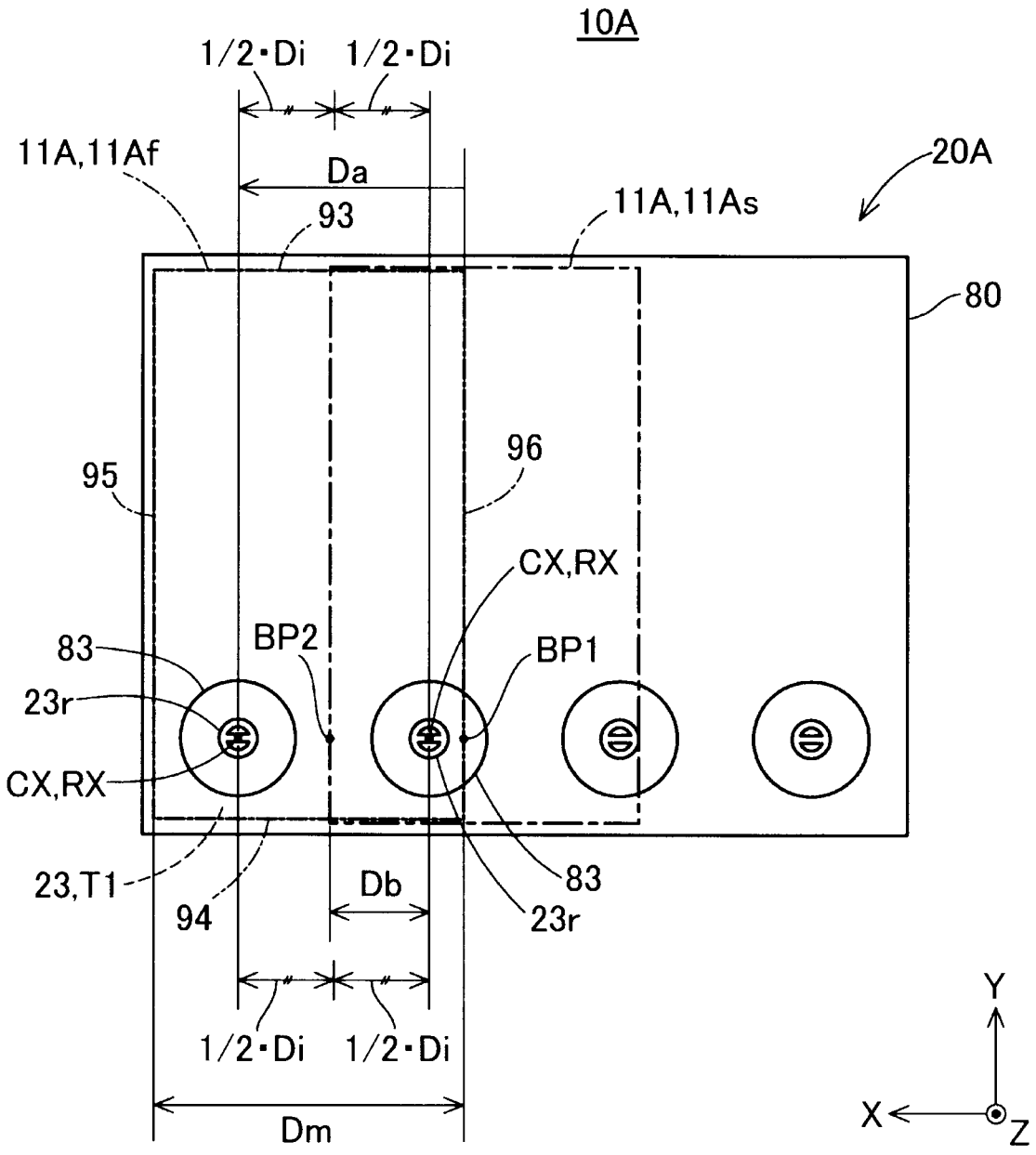
FIG. 12B is an outline plan view schematically showing the carriage of the second embodiment.

A configuration of the liquid supply system 10A according to a second embodiment will be described with reference to FIGS. 12A and 12B. FIG. 12A is an outline front view schematically showing the carriage 20A of the second embodiment when viewed in the +Y direction. FIG. 12B is an outline plan view schematically showing the carriage 20A of the second embodiment when viewed in the −Z direction. FIG. 12A shows a liquid container 11A of the second embodiment set to a liquid filling posture.

The configuration of the liquid supply system 10A of the second embodiment is substantially the same as the liquid supply system 10 of the first embodiment except that a liquid container 11A and a carriage 20A of the second embodiment are provided instead of the liquid container 11 and the carriage 20 of the first embodiment. The liquid supply system 10A of the second embodiment is incorporated in a liquid consumption system similar to that described in the first embodiment, and the carriage 20A is mounted on a liquid consumption apparatus having the same configuration as that described in the first embodiment. The configurations of the liquid container 11A and the carriage 20A of the second embodiment are substantially the same as the configurations of the liquid container 11 and the carriage 20 of the first embodiment, except for the differences described below.

In the carriage 20A of the second embodiment, a pair of rectangular hole sections 83*r* of each container receiving section 83 included in the adapter section 82 is omitted. Therefore, in the second embodiment, as shown in FIG. 12B, each container receiving section 83 is configured as a through hole having a substantially circular opening shape.

The container section 50A of the liquid container 11A of the second embodiment has a substantially rectangular parallelepiped shape. The container section 50A is manufactured by, for example, sealing an opening section of a rectangular box, which is formed by injection molding and having one entire surface region open, by bonding a film member. Alternatively, the container section 50A may be configured with a paper box that stores a resin bag member that stores a liquid inside. The liquid outlet port member 60 of the liquid container 11A has substantially the same configuration as the liquid outlet port member 60 described in the first embodiment, except that the pair of rectangular structure sections 70 are omitted.

The container section 50A includes the following six wall sections 91 to 96 surrounding the internal space 51. A first wall section 91 is a wall section to which the liquid outlet port member 60 is attached. A second wall section 92 is a wall section facing the first wall section 91 in the direction of the central axis CX of the liquid outlet port 61. A third wall section 93 is a wall section that intersects the first wall section 91 and the second wall section 92. A fourth wall section 94 is a wall section that intersects the first wall section 91 and the second wall section 92 and faces the third wall section 93 in a direction orthogonal to the central axis CX of the liquid outlet port 61. A fifth wall section 95 is a wall section that intersects the first wall section 91, the second wall section 92, the third wall section 93, and the fourth wall section 94. A sixth wall section 96 is a wall section that intersects the first wall section 91, the second wall section 92, the third wall section 93, and the fourth wall section 94, and faces the fifth wall section 95 in a direction orthogonal to the central axis CX of the liquid outlet port 61. Each of the wall sections 91 to 96 is formed in a planar plate shape. Each of the wall sections 91 to 96 may include a recess section or a projection section on the surface. Among each of the wall sections 91 to 96, for example, the sixth wall section may be formed of the above-described film member, and the remaining wall sections 91 to 95 may be formed of the above-described wall section of the housing member.

In the present specification, the "intersecting" between two objects means that the object is in one of a state in which two objects actually intersects each other, a state in which a virtually extended portion of one object intersects the other, and a state in which the virtually extended portions intersect each other. Therefore, for example, when saying "two wall sections intersect", a state in which the two wall sections are coupled to each other in a cross shape and a state in which the end sections of the two wall sections are coupled to each other to form a corner section are included. In this case, for example, a rounded corner section may be provided between two wall sections that intersect each other. Further, in the present specification, two objects "face" each other means to include both cases where no other object presents between two objects and cases where another object presents.

In the liquid container 11A, the liquid outlet port member 60 is positioned closer to the fifth wall section 95 than the sixth wall section 96 in the first wall section 91, and is provided at a position closer to the fourth wall section 94 than the third wall section 93. The liquid filling posture of the liquid container 11A is such that the central axis CX of the liquid outlet port 61 is positioned on the central axis RX of the liquid receiving section 23*r*, the first wall section 91 is oriented in the −Z direction, and the fourth wall section 94 is oriented in the −Y direction.

Here, the liquid container 11A shown in FIG. 12A is a first liquid container 11Af for the first tank T1 that supplies liquid to the first tank T1. In FIG. 12A, a disposition region of the second tank T2 when the second liquid container 11As for the second tank T2 is in the second tank filling posture is shown by a dashed line. In FIG. 12B, the disposition region of the first liquid container 11Af when having the first tank filling posture and the disposition region of the second liquid container 11As when having the second tank filling posture are respectively shown by dashed lines.

As shown in FIG. 12B, also in the liquid supply system 10A of the second embodiment, similarly to the liquid supply system 10 of the first embodiment, the relationship between the three distances Di, Da, and Db described in the first embodiment is established. Further, the maximum width Dm of the first liquid container 11Af when having the first tank filling posture in the X direction is longer than the distance Di. As shown in FIG. 12A, the liquid outlet port member 60 of the liquid container 11A is attached to a position shifted from the center of the width of the container section 50A in the X direction. In contrast to this, in another embodiment, the liquid outlet port member 60 may be provided at the center of the width of the container section 50A in the X direction while satisfying the relationship of the three distances Di, Da, and Db as described above.

In the liquid supply system 10A of the second embodiment, the end section portion of the first liquid container 11Af on the −X direction side when the first liquid container 11Af is set to the first tank filling posture interferes with the disposition region of the second liquid container 11As when the second liquid container 11As is set to the second tank filling posture. Therefore, also in the liquid filling posture of the second embodiment, the number of the liquid containers 11A that can be simultaneously coupled to the carriage 20A is limited, and shift or deformation of the installation position of the carriage 20A are suppressed. In addition, according to the liquid supply system 10A of the second embodiment, various functions and effects similar to those described in the first embodiment can be obtained.

3. Third Embodiment

Figure 13:
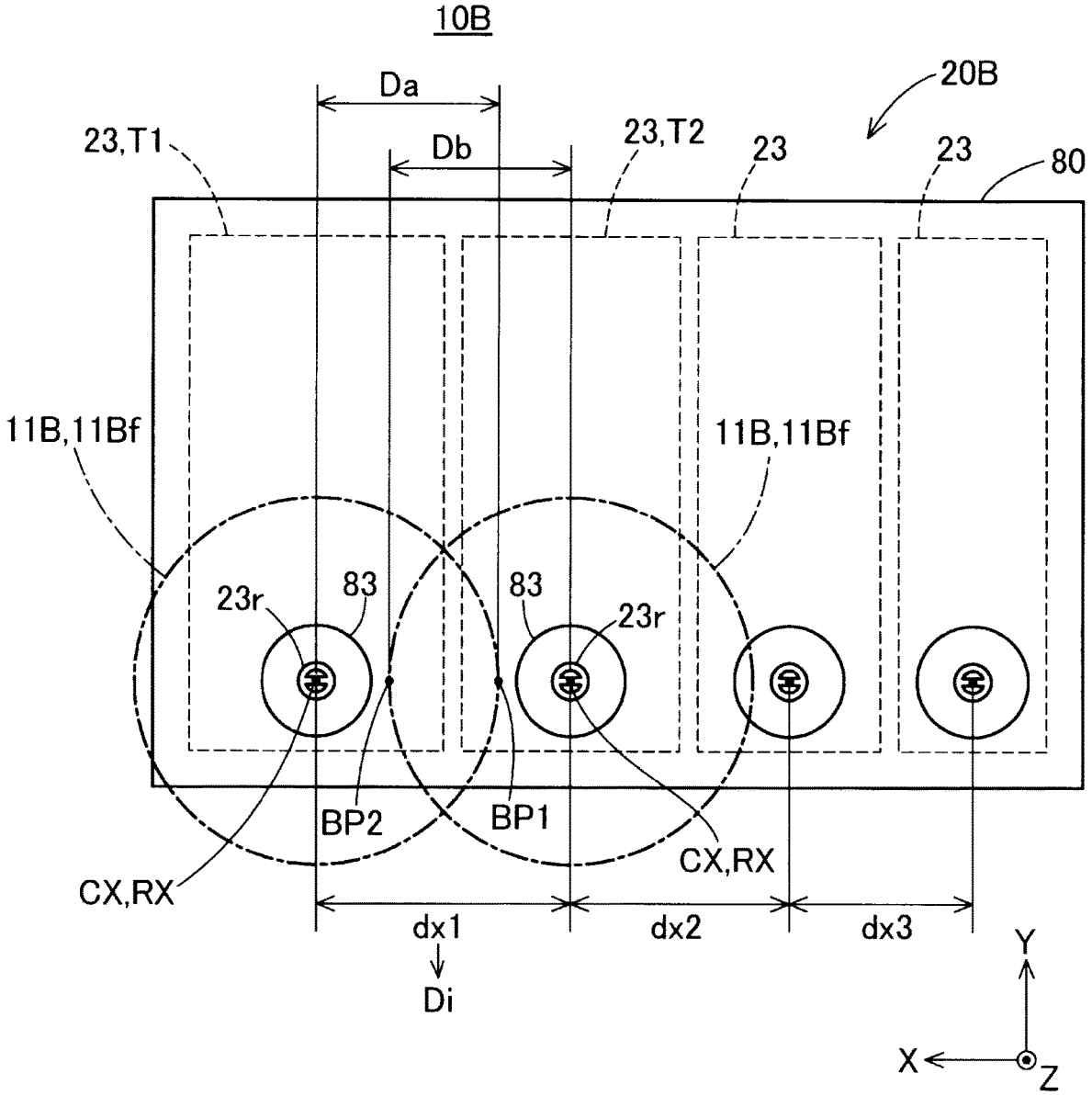
FIG. 13 is an outline plan view schematically showing a carriage of a third embodiment.

A configuration of the liquid supply system 10B according to a third embodiment will be described with reference to FIG. 13. FIG. 13 is an outline plan view schematically showing the carriage 20B of the third embodiment when viewed in the −Z direction. FIG. 13 shows a disposition region when the first liquid container 11Bf and the second liquid container 11Bs in the third embodiment are coupled to the carriage 20B of the third embodiment with the liquid filling posture by a dashed line.

The configuration of the liquid supply system 10B of the third embodiment is substantially the same as the liquid supply system 10 of the first embodiment except that a liquid container 11B and a carriage 20B of the third embodiment are provided instead of the liquid container 11 and the carriage 20 of the first embodiment. The configurations of the liquid container 11B and the carriage 20B of the third embodiment are substantially the same as the configurations of the liquid container 11 and the carriage 20 of the first embodiment, except for the differences described below. In the third embodiment, at least three or more tanks 23 are mounted on the carriage 20B. FIG. 13 shows a configuration in which four tanks 23 are mounted on the carriage 20B as an example.

In the liquid container 11B and the carriage 20B of the third embodiment, as in the second embodiment, the pair of rectangular structure sections 70 of the liquid outlet port member 60 and the pair of rectangular hole sections 83*r* of the container receiving section 83 are omitted. In the carriage 20B of the third embodiment, the number of mounted tanks 23 is different from that of the first embodiment. In the carriage 20B of the third embodiment, the widths of the plurality of tanks 23 in the X direction are different, and accordingly, the distances dx1, dx2, and dx3 between the central axes RX of a set of the adjacent liquid receiving sections 23*r* are different from each other. In the example in FIG. 13, the width of the tank 23 in the X direction is larger as it is positioned on the +X direction side. In addition, the distances dx1, dx2, and dx3 between the central axes RX of the set of the adjacent liquid receiving sections 23*r* are longer as they are positioned on the +X direction side, and a relationship of dx1>dx2>dx3 is established.

In the third embodiment, the set of tanks 23 having the largest distance between the central axes RX of the liquid receiving sections 23*r* is the first tank T1 and the second tank T2. Therefore, the distance Di between the liquid receiving section 23*r* of the first tank T1 and the second tank T2 is dx1, which is the maximum value of the distances dx1, dx2, and dx3.

The first liquid container 11Bf for the first tank T1 and the second liquid container 11Bs for the second tank T2 included in the plurality of liquid containers 11B have a dimension that satisfies the relationship between the distances Di, Da, and Db described in the first embodiment. Further, the maximum width of the first liquid container 11Bf when having the first tank filling posture in the X direction is longer than the distance Di. Therefore, according to the liquid supply system 10B of the third embodiment, the number of the liquid containers 11B that can be simultaneously coupled to the carriage 20B for filling the tank 23 with the liquid is limited as described in each of the above embodiments.

In particular, in the liquid supply system 10B of the third embodiment, the maximum value among the distances dx1, dx2, and dx3 between the central axes RX of the adjacent liquid receiving sections 23*r* in the carriage 20B is defined as the distance Di, and the dimensions of the first liquid container 11Bf and the second liquid container 11Bs are determined. Thereby, it is easier to cause the disposition region of the first liquid container 11Bf when having the first tank filling posture and the disposition region of the second liquid container 11Bs when having the second tank filling posture to interfere with each other. Further, regarding the other liquid containers 11B having the same dimensions as the first liquid container 11Bf and the second liquid container 11Bs, it is possible to prevent the adjacent liquid containers from being simultaneously coupled to the carriage 20. Therefore, the number of liquid containers 11B that can be simultaneously coupled to the carriage 20B for filling the tank 23 with the liquid can be further limited. In addition, according to the liquid supply system 10B of the third embodiment, various functions and effects similar to those described in the above embodiments can be obtained.

4. Fourth Embodiment

Figure 14:
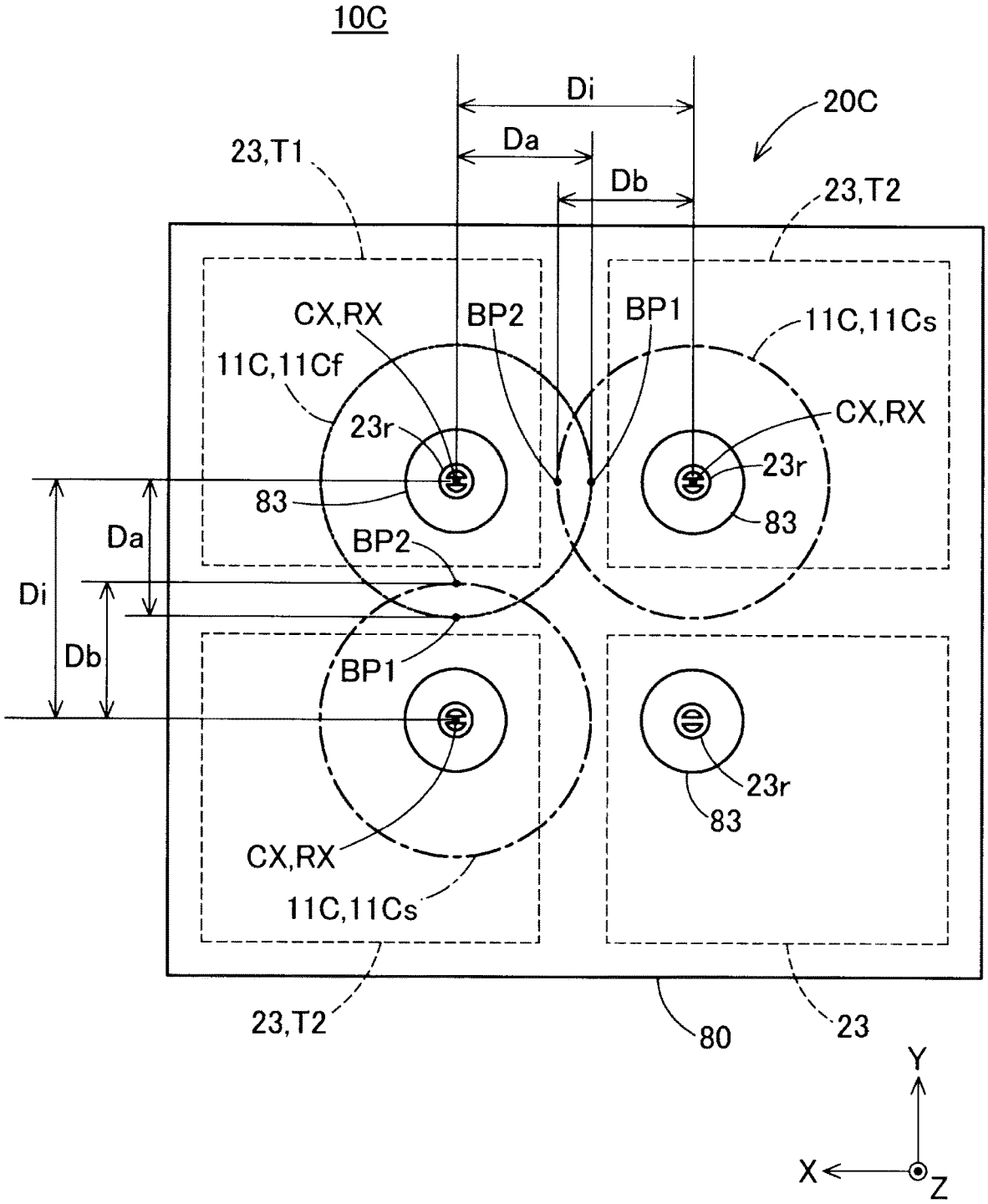
FIG. 14 is an outline plan view schematically showing a carriage of a fourth embodiment.

A configuration of the liquid supply system 10C according to a fourth embodiment will be described with reference to FIG. 14. FIG. 14 is an outline plan view schematically showing the carriage 20C of the fourth embodiment when viewed in the −Z direction. FIG. 14 shows a disposition region when the first liquid container 11Cf and the second liquid container 11Cs in the fourth embodiment are coupled to the carriage 20C of the third embodiment with the liquid filling posture by a dashed line.

The configuration of the liquid supply system 100 of the fourth embodiment is substantially the same as the liquid supply system 10 of the first embodiment except that a liquid container 11C and a carriage 20C of the fourth embodiment are provided instead of the liquid container 11 and the carriage 20 of the first embodiment. The configurations of the liquid container 11C and the carriage 20C of the fourth embodiment are substantially the same as the configurations of the liquid container 11 and the carriage 20 of the first embodiment, except for the differences described below.

In the liquid container 11C and the carriage 20C of the fourth embodiment, as in the second embodiment, the pair of rectangular structure sections 70 of the liquid outlet port member 60 and the pair of rectangular hole sections 83*r* of the container receiving section 83 are omitted. In the carriage 20C of the fourth embodiment, the number of mounted tanks 23 is different from that of the first embodiment. Further, in the carriage 20C of the fourth embodiment, the plurality of tanks 23, the container receiving section 83, and the liquid receiving section 23*r* are arranged in the X direction and the Y direction. In the example in FIG. 14, a plurality of tanks 23, a liquid receiving section 23*r*, and a container receiving section 83 are arranged two in the X direction and two in the Y direction.

In the liquid supply system 10C of the fourth embodiment, the two liquid containers 11C respectively coupled to the adjacent liquid receiving sections 23*r* with the X direction as the arrangement direction may be the first tank T1 and the second tank T2. Alternatively, the two liquid containers 11C respectively coupled to the adjacent liquid receiving sections 23*r* with the Y direction as the arrangement direction may be the first tank T1 and the second tank T2. In any case, in the liquid supply system 10C of the fourth embodiment, the first liquid container 11Cf for the first tank T1 and the second liquid container 11Cs for the second tank T2 have a dimension that satisfies the relationship between the distances Di, Da, and Db described in the first embodiment.

According to the liquid supply system 10C of the fourth embodiment, the number of the liquid containers 11C that can be simultaneously coupled to the carriage 20C for filling the tank 23 with the liquid is limited as described in each of the above embodiments. In addition, according to the liquid supply system 10C of the fourth embodiment, various functions and effects similar to those described in the above embodiments can be obtained.

5. Fifth Embodiment

Figure 15:
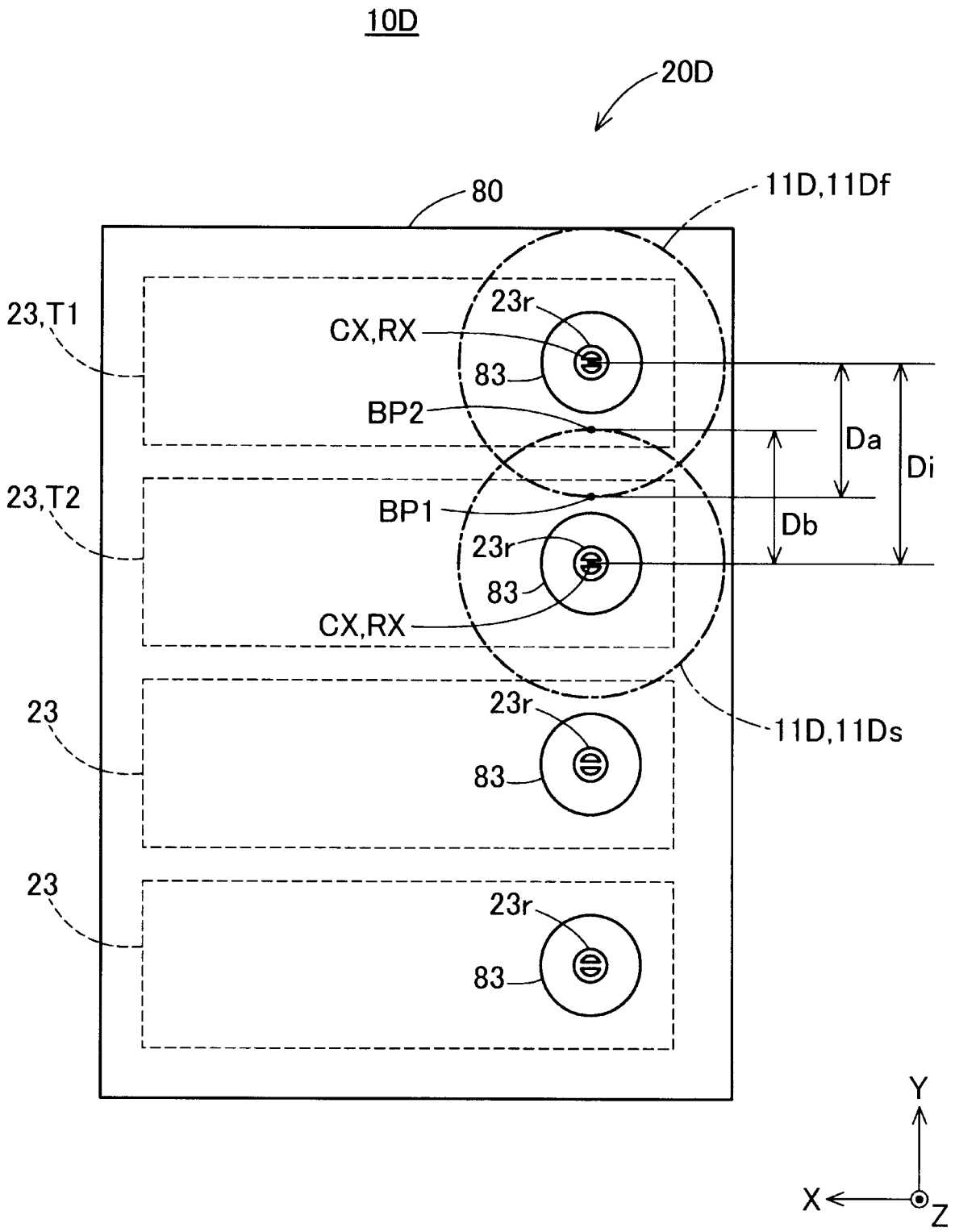
FIG. 15 is an outline plan view schematically showing a carriage of a fifth embodiment.

A configuration of the liquid supply system 10D according to a fifth embodiment will be described with reference to FIG. 15. FIG. 15 is an outline plan view schematically showing the carriage 20D of the fifth embodiment when viewed in the −Z direction. FIG. 15 shows a disposition region when the first liquid container 11Df and the second liquid container 11Ds in the fifth embodiment are coupled to the carriage 20D of the fifth embodiment with the liquid filling posture by a dashed line.

The configuration of the liquid supply system 10D of the fifth embodiment is substantially the same as the liquid supply system 10 of the first embodiment except that a liquid container 11D and a carriage 20D of the fifth embodiment are provided instead of the liquid container 11 and the carriage 20 of the first embodiment. The configurations of the liquid container 11D and the carriage 20D of the fifth embodiment are substantially the same as the configurations of the liquid container 11 and the carriage 20 of the first embodiment, except for the differences described below.

In the liquid container 11D and the carriage 20D of the fifth embodiment, as in the second embodiment, the pair of rectangular structure sections 70 of the liquid outlet port member 60 and the pair of rectangular hole sections 83*r* of the container receiving section 83 are omitted. In the carriage 20D of the fifth embodiment, the number of mounted tanks 23 is different from that of the first embodiment. Further, in the carriage 20D of the fifth embodiment, the plurality of tanks 23 and the liquid receiving sections 23*r* of the tanks are arranged in the Y direction. That is, in the fifth embodiment, the arrangement direction of the liquid receiving sections 23*r* is a direction perpendicular to the main scanning direction of the carriage 20D.

In the liquid supply system 10D of the fifth embodiment, the first liquid container 11Df for the first tank T1 and the second liquid container 11Ds for the second tank T2 have a dimension that satisfies the relationship between the distances Di, Da, and Db described in the first embodiment. Therefore, according to the liquid supply system 10D of the fifth embodiment, the number of the liquid containers 11D that can be simultaneously coupled to the carriage 20D for filling the tank 23 with the liquid is limited as described in each of the above embodiments. In addition, according to the liquid supply system 10D of the fifth embodiment, various functions and effects similar to those described in the above embodiments can be obtained.

6. Sixth Embodiment

Figure 16:
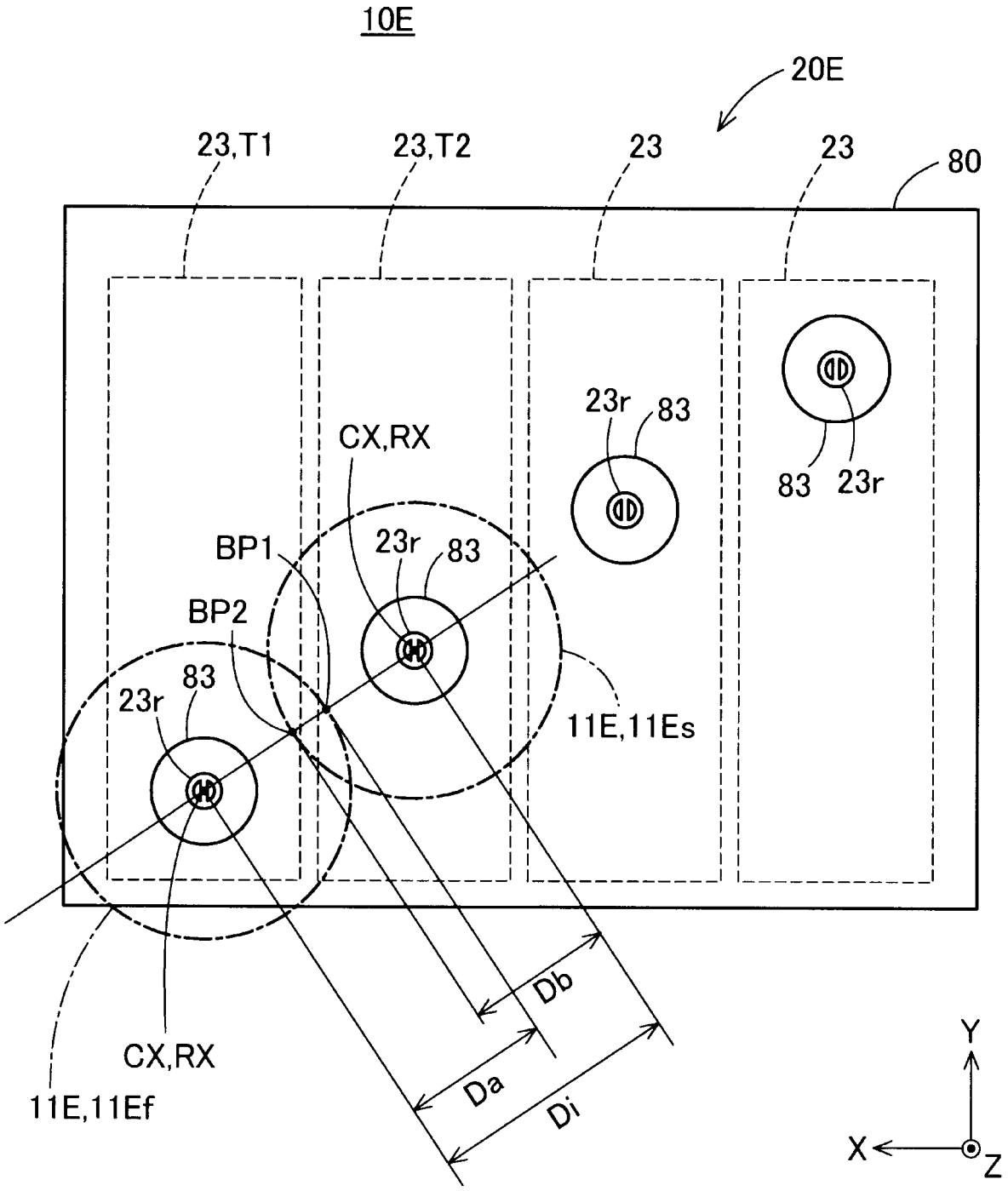
FIG. 16 is an outline plan view schematically showing a carriage of a sixth embodiment.

A configuration of the liquid supply system 10E according to a sixth embodiment will be described with reference to FIG. 16. FIG. 16 is an outline plan view schematically showing the carriage 20E of the sixth embodiment when viewed in the −Z direction. FIG. 16 shows a disposition region when the first liquid container 11Ef and the second liquid container 11Es in the sixth embodiment are coupled to the carriage 20E of the sixth embodiment with the liquid filling posture by a dashed line.

The configuration of the liquid supply system 10E of the sixth embodiment is substantially the same as the liquid supply system 10 of the first embodiment except that a liquid container 11E and a carriage 20E of the sixth embodiment are provided instead of the liquid container 11 and the carriage 20 of the first embodiment. The configurations of the liquid container 11E and the carriage 20E of the sixth embodiment are substantially the same as the configurations of the liquid container 11 and the carriage 20 of the first embodiment, except for the differences described below.

In the liquid container 11E and the carriage 20E of the sixth embodiment, as in the second embodiment, the pair of rectangular structure sections 70 of the liquid outlet port member 60 and the pair of rectangular hole sections 83*r* of the container receiving section 83 are omitted. In the carriage 20E of the sixth embodiment, the number of mounted tanks 23 is different from that of the first embodiment. Further, in the carriage 20E of the sixth embodiment, the position where the liquid receiving section 23*r* is provided is different in each of the plurality of tanks 23, and the liquid receiving sections 23*r* are arranged in a direction crossing each of the Y direction and the X direction. That is, in the fifth embodiment, the arrangement direction of the liquid receiving sections 23*r* is a direction obliquely intersecting the main scanning direction of the carriage 20E.

In the liquid supply system 10E of the sixth embodiment, the first liquid container 11Ef for the first tank T1 and the second liquid container 11Es for the second tank T2 have a dimension that satisfies the relationship between the distances Di, Da, and Db described in the first embodiment. Therefore, according to the liquid supply system 10E of the sixth embodiment, the number of the liquid containers 11E that can be simultaneously coupled to the carriage 20E for filling the tank 23 with the liquid is limited as described in each of the above embodiments. In addition, according to the liquid supply system 10E of the sixth embodiment, various functions and effects similar to those described in the above embodiments can be obtained.

7. Other Embodiments

The various configurations described in the above embodiments can be modified as follows, for example. Any of the other embodiments described below is positioned as an example of an aspect for carrying out the technology of the present disclosure, like the above-described embodiments. In the following, unless otherwise specified, the liquid supply systems 10, 10A to 10E, the liquid containers 11, 11A to 11E, and the carriages 20, 20A to 20E of each of the above embodiments are referred to as the liquid supply system 10, the liquid container 11, and the carriage 20, respectively, without distinction.

Other Embodiment 1

The number of tanks 23 mounted on the carriage 20 is not limited to the number described in each of the above embodiments or the number shown in the referenced drawings. In the tank 23, only two tanks T1 and T2 corresponding to the first tank T1 and the second tank T2 may be mounted on the carriage 20. More than five tanks 23 may be mounted on the carriage 20. Further, the plurality of tanks 23 may have an integrated configuration, or may have a configuration in which some or all of the plurality of tanks 23 are separately separated.

Other Embodiment 2

The liquid filling posture of the liquid container 11 is not limited to the posture described in each of the above embodiments. The liquid filling posture may be, for example, a posture in which the central axis CX of the liquid outlet port 61 of the liquid container 11 obliquely intersects the central axis RX of the liquid receiving section 23*r*. Further, the liquid filling postures of the respective liquid containers 11 included in the liquid supply system 10 may be different from each other. The liquid container 11 may not be configured to self-stand on the tank 23 of the carriage 20 in the liquid filling posture. The liquid container 11 may be set to the liquid filling posture while being held by a user without the intervention of the adapter section 82. Alternatively, the liquid container 11 may be configured to self-stand on the tank 23 of the carriage 20 in the liquid filling posture with a configuration other than that the front end section of the liquid outlet port member 60 is fitted to the container receiving section 83 of the adapter section 82. In the liquid container 11, a supporting section that supports the self-stand in the liquid filling posture may be provided around the cylindrical conduit section 62 of the liquid outlet port member 60.

Other Embodiment 3

The shapes and dimensions of the plurality of liquid containers 11 included in the liquid supply system 10 may be different from each other. The shape of the container section 50 of the liquid container 11 is not limited to a rectangular parallelepiped shape or a cylindrical shape. The shape of the container section 50 may be a polygonal column shape, or may have various irregular shapes such as, for example, a portion that partly protrudes locally.

Other Embodiment 4

Each liquid container 11 may not be provided with the valve body 63. Each liquid container 11 may have a configuration in which, for example, the liquid flows out from the liquid outlet port 61 when the liquid outlet port 61 is inclined toward the lower side. Each tank 23 may not have the visual checking section 23*v*. Further, the sensor member 86 of the tank 23 may be omitted.

8. Modification Example

The technology of the present disclosure is not limited to the above embodiments and examples, and can be implemented in various forms without departing from the spirit of the technology. For example, the technology of the present disclosure can be realized as the following embodiments. The technical features in each of the above embodiments corresponding to the technical features in each of the modes described below are used to solve some or all of the problems to be achieved by the technology of the present disclosure, or in order to achieve some or all of the effects to be achieved by the technology of the present disclosure, replacement or combination can be appropriately performed. If the technical features are not described as essential in the present specification, the features can be deleted as appropriate.

(1) A first aspect is provided as a liquid supply system for supplying liquid to a liquid jet head that discharges the liquid. The liquid supply system according to this aspect includes: a carriage on which the liquid jet head is mounted; a plurality of tanks mounted on the carriage and having a storing section that stores the liquid and a liquid receiving section that receives a liquid for filling the storing section with the liquid from an outside; and a plurality of liquid containers each having a container section that stores the liquid and a liquid outlet port that communicates with an internal space of the container section, and filling a corresponding tank among the plurality of tanks with the liquid in the container section in a state where the liquid outlet port is coupled to the liquid receiving section. The plurality of tanks include a first tank and a second tank in which the liquid receiving sections are disposed adjacent to each other in an arrangement direction in the carriage, the plurality of liquid containers include a first liquid container that fills the first tank with the liquid and a second liquid container that fills the second tank with the liquid, and the first liquid container has a portion that, when the first liquid container is set to a predetermined first tank filling posture for filling the first tank with the liquid, interferes with a disposition region of the second liquid container when the second liquid container is set to a predetermined second tank filling posture for filling the second tank with the liquid.

According to the liquid supply system according this aspect, when the first liquid container is in the first tank filling posture and filling the first tank with the liquid, filling the second tank with the liquid when the second liquid container is in the second tank filling posture can be inhibited by interference of the first liquid container. Thereby, the number of liquid containers that can simultaneously fill the plurality of tanks mounted on the carriage with the liquid is limited, so that it is possible to prevent the carriage from receiving a load due to a simultaneous liquid filling from a large number of liquid containers. Therefore, it is possible to suppress the occurrence of such a problem that the installation posture of the carriage is shifted or the carriage is deformed. Further, it is possible to suppress a situation in which a user tries to perform liquid replenish from a large number of liquid containers to a large number of tanks at the same time and erroneously manages the liquid containers.

(2) In the liquid supply system according to the above aspect, the first tank filling posture may be a posture in which the liquid outlet port of the first liquid container faces the liquid receiving section of the first tank and a central axis of the liquid outlet port of the first liquid container is positioned on a central axis of the liquid receiving section of the first tank, the second tank filling posture may be a posture in which the liquid outlet port of the second liquid container faces the liquid receiving section of the second tank and a central axis of the liquid outlet port of the second liquid container is positioned on a central axis of the liquid receiving section of the second tank, the first liquid container may be configured to self-stand on the first tank in the first tank filling posture, and the second liquid container may be configured to self-stand on the second tank in the second tank filling posture.

According to the liquid supply system of this aspect, the operation of filling the first tank and the second tank with the liquid from the first liquid container and the second liquid container can be facilitated.

(3) In the liquid supply system according to the above aspect, when the first liquid container is in the first tank filling posture, a distance Da between the central axis of the liquid outlet port of the first liquid container and a portion of the first liquid container closest to the central axis of the liquid receiving section of the second tank in the arrangement direction may be longer than ½ of a distance Di between the central axes of the liquid receiving section of the first tank and the liquid receiving section of the second tank, and when the second liquid container is in the second tank filling posture, a distance Db between the central axis of the liquid outlet port of the second liquid container and a portion of the second liquid container closest to the central axis of the liquid receiving section of the first tank in the arrangement direction may be longer than ½ of the distance Di.

According to the liquid supply system of this aspect, the first liquid container and the second liquid container can be configured with a dimension in which the disposition region of the first liquid container when having the first tank filling posture and the disposition region of the second liquid container when having the second tank filling posture interfere with each other.

(4) In the liquid supply system according to the above aspect, a maximum width of the first liquid container when having the first tank filling posture in the arrangement direction may be larger than a distance Di between the central axes of the liquid receiving section of the first tank and the liquid receiving section of the second tank.

According to the liquid supply system of this aspect, it is possible to make the first liquid container more easily interfere with the disposition region of the second liquid container when having the second tank filling posture. Therefore, it is possible to make it more difficult to simultaneously perform liquid filling from both the first liquid container and the second liquid container into the first tank and the second tank.

(5) In the liquid supply system according to the above aspect, three or more of the plurality of tanks may be mounted on the carriage, and the distance Di may be the longest among the distances between the central axes of the liquid receiving sections adjacent to each other in the carriage.

According to the liquid supply system of this aspect, the number of liquid containers that can simultaneously fill the tanks in the carriage with the liquid can be more easily limited.

(6) In the liquid supply system according to the above aspect, in each of the plurality of liquid containers, the liquid outlet port may be provided with a valve body having a slit for opening and closing the liquid outlet port by elastic deformation.

According to the liquid supply system of this aspect, since the number of liquid containers that can simultaneously fill the tanks in the carriage with liquid is limited, it is possible to prevent the valve body from being left open for filling the tank with the liquid from the liquid container as compared with the case where there is no such limitation. Therefore, performance degradation due to a decrease in the elastic force of the valve body can be suppressed.

(7) In the liquid supply system according to the above aspect, the plurality of tanks may be provided with a visual checking section for a user to visually check a remaining amount of the liquid in the storing section from the outside.

According to the liquid supply system of this aspect, since the installation posture of the carriage is prevented from being shifted in the operation of filling the tank with the liquid, it is possible to prevent a user from inaccurately grasping the liquid amount through the visual checking section due to the inclination of the tank.

(8) In the liquid supply system according to the above aspect, in each of the plurality of tanks, the storing section may be provided with a sensor member for detecting a remaining amount of the liquid.

According to the liquid supply system of this aspect, since the installation posture of the carriage is prevented from being shifted in the operation of filling the tank with the liquid, it is possible to suppress an inaccurate grasp of the liquid amount using the sensor member due to the inclination of the tank.

9. Other

The technology of the present disclosure can be realized in various forms other than the liquid supply system. For example, the present disclosure can be realized in the form of a liquid container, a liquid consumption system, a liquid consumption apparatus, a method of replenishing a tank with liquid, or the like.

In the present specification, the terms "filling", "replenishing", and "refilling" for liquid are concepts that include any of the operations (i) to (iii) in the following examples. Further, these terms may be interchanged with each other as appropriate as long as no inconsistency arises.

(i) an operation of filling an empty container with liquid.

(ii) an operation of raising a position of a liquid level stored in a container from a position of a predetermined lower limit or a position smaller than the lower limit.

(iii) an operation of filling a container with liquid until the amount of the liquid stored in the container reaches a predetermined upper limit.

The configuration of the liquid container according to the present disclosure can be applied to a liquid container used in any liquid consumption apparatus that consumes liquid other than ink. For example, the present disclosure can be applied to liquid containers used in various types of liquid consumption apparatuses described below.

- an image recording apparatus such as a facsimile apparatus.
- a color material ejecting apparatus used for manufacturing a color filter for an image display apparatus such as a liquid crystal display.
- an electrode material ejecting apparatus used for forming electrodes such as an organic electro luminescence (EL) display and a field emission display (FED).
- a liquid ejecting apparatus that ejects liquid containing a biological organic substance used for manufacturing a biochip.
- a sample ejecting apparatus as a precision pipette.
- a lubricating oil ejecting apparatus.
- a resin liquid ejecting apparatus.
- a liquid ejecting apparatus that ejects lubricating oil into a precision machine such as watches and cameras.
- a liquid ejecting apparatus that ejects a transparent resin liquid such as an ultraviolet curable resin liquid onto a substrate to form a micro hemispherical lens (optical lens) used for an optical communication element or the like.
- a liquid ejecting apparatus that ejects an acidic or alkaline etching solution to etch a substrate or the like.
- a liquid ejecting apparatus including a liquid consuming head for discharging any other minute amount of droplets.

The liquid stored in the liquid container of the present disclosure may be material in a state when the substance is in a liquid phase. Therefore, the "liquid" in the present disclosure includes material in a liquid state having high or low viscosity, sol, gel water, other inorganic solvents, organic solvents, solutions, liquid resins, and liquid state material such as liquid metal including metal melt. Further, not only liquid as one state of a substance but also material in which particles of a functional material formed of a solid such as a pigment or metal particles are dissolved, dispersed, or mixed in a solvent is included. In addition, typical examples of the liquid include ink or liquid crystal as described in the above embodiment. The term "ink" includes general water-based ink, oil-based ink, and various liquid compositions such as dye ink, pigment ink, gel ink, and hot melt ink.

What is claimed is:

1. A liquid supply system for supplying liquid to a liquid jet head that discharges the liquid, the system comprising:

a carriage on which the liquid jet head is mounted;

a plurality of tanks mounted on the carriage and having a storing section that stores the liquid and a liquid receiving section that receives a liquid for filling the storing section with the liquid from an outside; and a plurality of liquid containers each having a container section that stores the liquid and a liquid outlet port that communicates with an internal space of the container section, and filling a corresponding tank among the plurality of tanks with the liquid in the container section in a state where the liquid outlet port is coupled to the liquid receiving section, wherein the plurality of tanks include a first tank and a second tank in which the liquid receiving sections are disposed adjacent to each other in an arrangement direction in the carriage, the plurality of liquid containers include a first liquid container that fills the first tank with the liquid and a second liquid container that fills the second tank with the liquid, the first liquid container has a portion that, when the liquid outlet port of the first liquid container is coupled to the liquid receiving section of the first tank, overlaps a disposition region for the second liquid container that takes a predetermined second tank filling posture for filling the second tank with the liquid, and the second liquid container has a portion that, when the liquid outlet port of the second liquid container is coupled to the liquid receiving section of the second tank, overlaps a disposition region for the first liquid container that takes a predetermined first tank filling posture for filling the first tank with the liquid, wherein the first tank filling posture is a posture in which the liquid outlet port of the first liquid container faces the liquid receiving section of the first tank and a central axis of the liquid outlet port of the first liquid container is positioned on a central axis of the liquid receiving section of the first tank, the second tank filling posture is a posture in which the liquid outlet port of the second liquid container faces the liquid receiving section of the second tank and a central axis of the liquid outlet port of the second liquid container is positioned on a central axis of the liquid receiving section of the second tank, the first liquid container is configured to self-stand on the first tank in the first tank filling posture, and the second liquid container is configured to self-stand on the second tank in the second tank filling posture, and wherein when the first liquid container is in the first tank filling posture, a distance Da between the central axis of the liquid outlet port of the first liquid container and a portion of the first liquid container closest to the central axis of the liquid receiving section of the second tank in the arrangement direction is longer than ½ of a distance Di between the central axes of the liquid receiving section of the first tank and the liquid receiving section of the second tank, and when the second liquid container is in the second tank filling posture, a distance Db between the central axis of the liquid outlet port of the second liquid container and a portion of the second liquid container closest to the central axis of the liquid receiving section of the first tank in the arrangement direction is longer than ½ of the distance Di.

2. The liquid supply system according to claim 1, wherein a maximum width of the first liquid container when having the first tank filling posture in the arrangement direction is larger than a distance Di between the central axes of the liquid receiving section of the first tank and the liquid receiving section of the second tank.

3. The liquid supply system according to claim 1, wherein three or more of the plurality of tanks are mounted on the carriage, and the distance Di is the longest among the distances between the central axes of the liquid receiving sections adjacent to each other in the carriage.

4. The liquid supply system according to claim 1, wherein in each of the plurality of liquid containers, the liquid outlet port is provided with a valve body having a slit for opening and closing the liquid outlet port by elastic deformation.

5. The liquid supply system according to claim 1, wherein the plurality of tanks are provided with a visual checking section for a user to visually check a remaining amount of the liquid in the storing section from the outside.

6. The liquid supply system according to claim 1, wherein in each of the plurality of tanks, the storing section is provided with a sensor member for detecting a remaining amount of the liquid.

7. A liquid container for filling a storing section of a first tank of a plurality of tanks mounted on a carriage on which a liquid jet head that discharges liquid is mounted with the liquid through a liquid receiving section of the first tank, the plurality of tanks storing the liquid supplied to the liquid jet head, and each having the storing section in which the liquid is stored, and the liquid receiving section that receives the liquid for filling the storing section with the liquid, the plurality of tanks including a second tank, the liquid receiving sections of the first tanks and the second tank being disposed adjacent to each other in an arrangement direction in the carriage, the liquid container comprising:

a container section in which the liquid is stored, and a liquid outlet port that communicates with an internal space of the container section and is coupled to the liquid receiving section of the first tank when filling the first tank with the liquid, wherein the liquid container has a portion that, when the liquid outlet port of the liquid container is coupled to the liquid receiving section of the first tank, overlaps a disposition region of another liquid container for the second tank that takes a predetermined second tank filling posture for filling the second tank with the liquid, and the other liquid container for the second tank has a portion that, when a liquid outlet portion of the other liquid container for the second tank is couple to the liquid receiving section of the second tank, overlaps a disposition region for the liquid container that takes a predetermined first tank filling posture for filling the first tank with the liquid, wherein the first tank filling posture is a posture in which the liquid outlet port of the liquid container faces the liquid receiving section of the first tank and a central axis of the liquid outlet port of the liquid container is positioned on a central axis of the liquid receiving section of the first tank, the second tank filling posture is a posture in which the liquid outlet port of the other liquid container faces the liquid receiving section of the second tank and a central axis of the liquid outlet port of the other liquid container is positioned on a central axis of the liquid receiving section of the second tank, the liquid container is configured to self-stand on the first tank in the first tank filling posture, and the other liquid container is configured to self-stand on the second tank in the second tank filling posture, and wherein when the liquid container is in the first tank filling posture, a distance Da between the central axis of the liquid outlet port of the first liquid container and a portion of the liquid container closest to the central axis of the liquid receiving section of the second tank in the arrangement direction is longer than ½ of a distance Di between the central axes of the liquid receiving section of the first tank and the liquid receiving section of the second tank, and when the other liquid container is in the second tank filling posture, a distance Db between the central axis of the liquid outlet port of the other liquid container and a portion of the other liquid container closest to the central axis of the liquid receiving section of the first tank in the arrangement direction is longer than ½ of the distance Di.

* * * * *